United States Patent [19]

Gonzalez et al.

[11] Patent Number: 4,905,014

[45] Date of Patent: Feb. 27, 1990

[54] MICROWAVE PHASING STRUCTURES FOR ELECTROMAGNETICALLY EMULATING REFLECTIVE SURFACES AND FOCUSING ELEMENTS OF SELECTED GEOMETRY

[75] Inventors: Daniel G. Gonzalez, Alhambra; Gerald E. Pollon; Joel F. Walker, both of Malibu, all of Calif.

[73] Assignee: Malibu Research Associates, Inc., Calabasas, Calif.

[21] Appl. No.: 178,063

[22] Filed: Apr. 5, 1988

[51] Int. Cl.[4] ..... H01Q 3/40

[52] U.S. Cl. ..... 343/909; 343/700 MS; 343/754; 343/910

[58] Field of Search ..... 343/900 MS, 754, 756, 343/778, 909, 910; 342/81, 360, 368, 377

[56] References Cited

U.S. PATENT DOCUMENTS

| | | | |
|---|---|---|---|
| 3,148,370 | 9/1964 | Bowman | 343/909 |
| 3,530,475 | 9/1970 | Danielson | 343/910 |
| 4,160,254 | 7/1979 | Wise | 343/909 |
| 4,228,437 | 10/1980 | Shelton | 343/909 |
| 4,260,994 | 4/1981 | Parker | 342/368 |
| 4,287,520 | 9/1981 | Van Vliet et al. | 343/909 |
| 4,307,404 | 12/1981 | Young | 343/909 |
| 4,358,771 | 11/1982 | Hsieh | 342/368 |
| 4,656,487 | 4/1987 | Sureau et al. | 343/909 |
| 4,684,952 | 8/1987 | Munson | 343/754 |
| 4,721,966 | 1/1988 | McGrath | 343/754 |
| 4,733,244 | 3/1988 | Edenhofer et al. | 343/909 |
| 4,754,286 | 6/1988 | Brunner et al. | 343/771 |
| 4,797,682 | 1/1989 | Klimczak | 343/844 |

FOREIGN PATENT DOCUMENTS

| | | | |
|---|---|---|---|
| 3402659 | 8/1985 | Fed. Rep. of Germany | 343/909 |

OTHER PUBLICATIONS

Hsiao, J., Multiple Frequency Phase Array of Dielectric Loaded Waveguides G—AP International Symposium, Columbus, OH, 1970.

Milne, R., Dipole Array Lens Antenna, IEEE Transactions on Antennas and Propagation, vol. AP-30, No. 4, Jul. 1982.

*Primary Examiner*—Rolf Hille
*Assistant Examiner*—Doris J. Johnson
*Attorney, Agent, or Firm*—Hoffman & Baron

[57] ABSTRACT

The present invention concerns an electrically thin microwave phasing structure for electromagnetically emulating a desired reflective surface of selected geometry over an operating frequency band. The microwave phasing structure comprises a support matrix and a reflective means for reflecting microwaves within the frequency operating band. The reflective means is supported by the support matrix. An arrangement of electromagnetically-loading structures is supported by the support matrix at a distance from the reflective means which can be less than a fraction of the wavelength of the highest frequency in the operating frequency range. The electromagnetically-loading structures are dimensioned, oriented, and interspaced from each other and disposed at a distance from the reflective means, as to provide the emulation of the desired reflective surface of selected geometry.

Another aspect of the present invention is the use of the electrically thin microwave phasing structure for electromagnetically emulating a desired microwave focusing element of a selected geometry.

Additionally, methods are provided for designing and manufacturing electrically thin microwave phasing structures for electromagnetically emulating desired reflective surfaces and focusing elements of selected geometry, which methods may include the use of computer-aided design and photo-etching techniques.

68 Claims, 10 Drawing Sheets

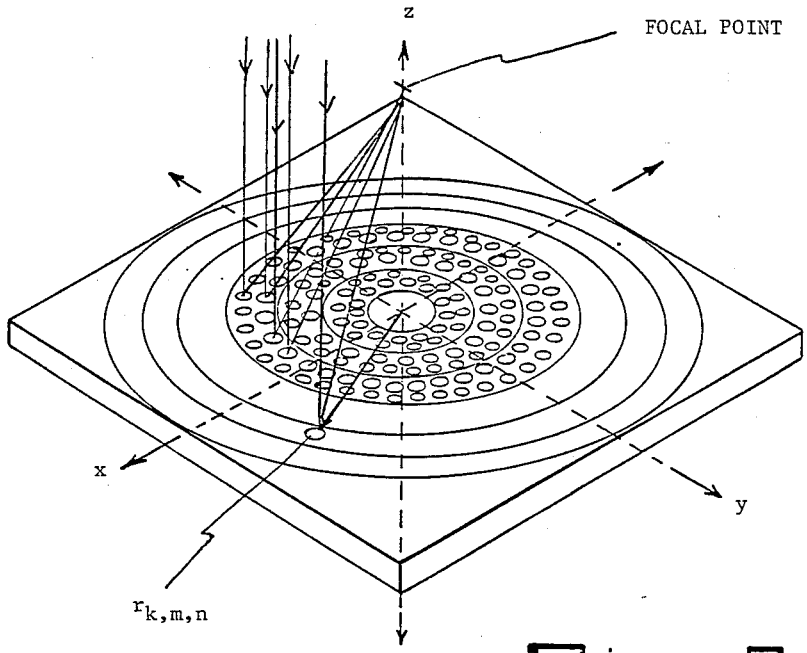
Fig. 7A
Fig. 7B
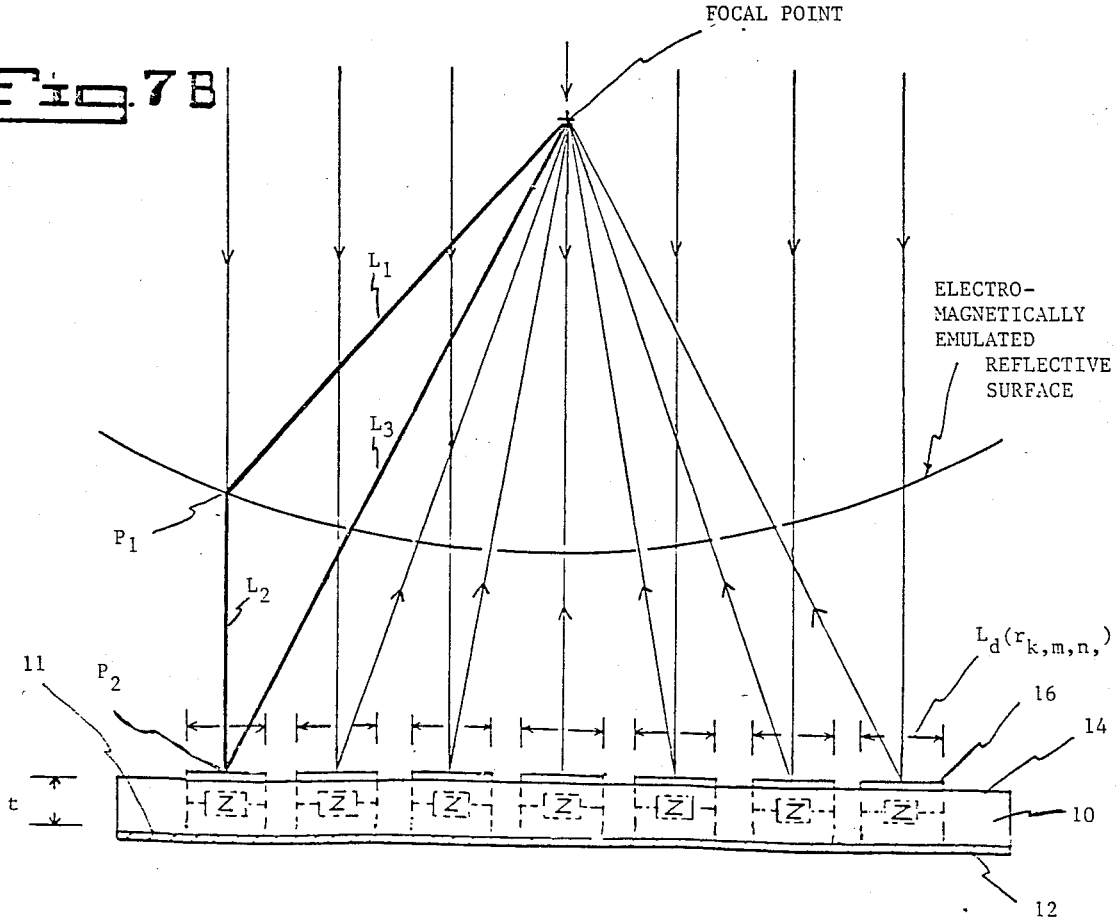

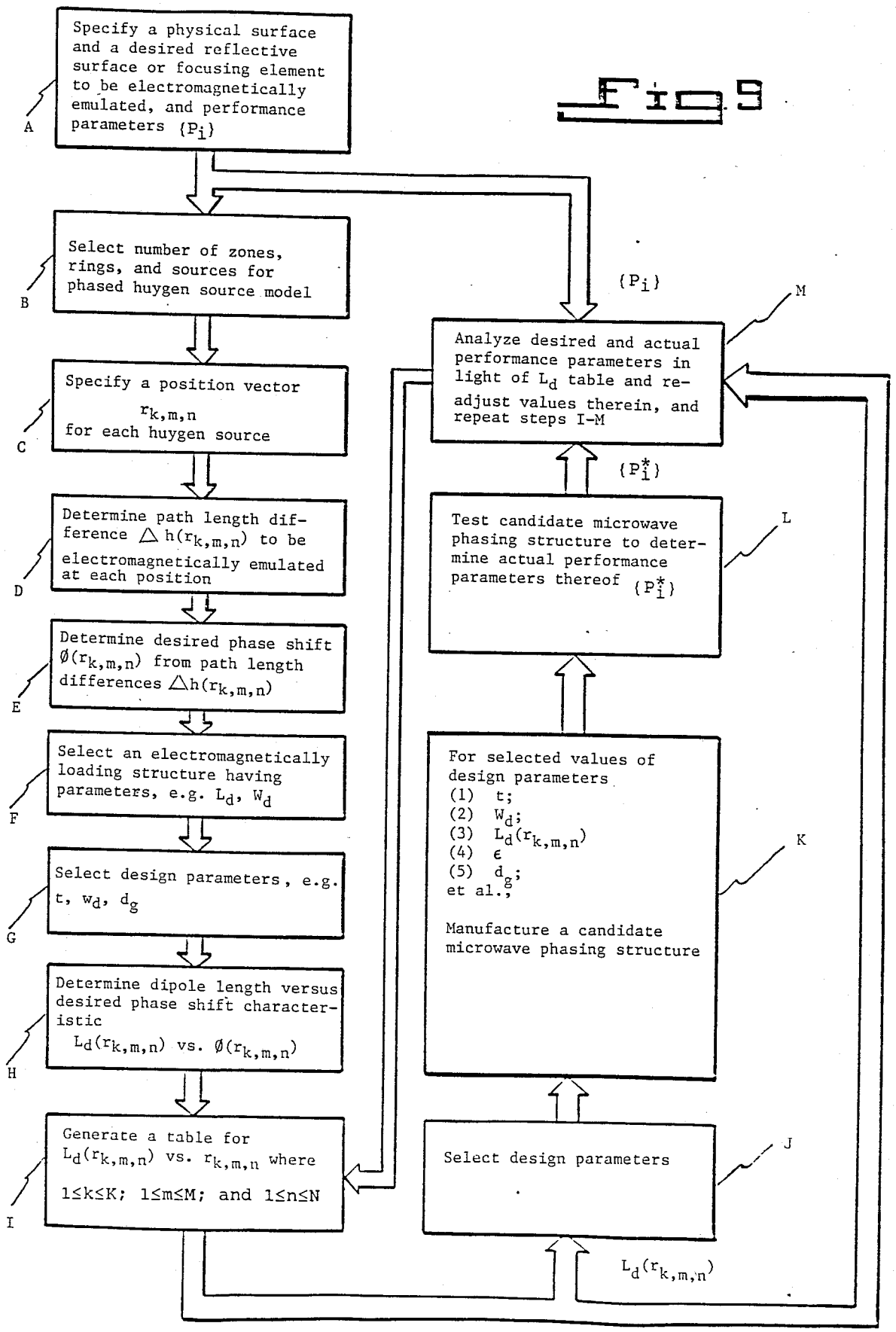
Fig. 9
A
Specify a physical surface and a desired reflective surface or focusing element to be electromagnetically emulated, and performance parameters $\{P_i\}$
B
Select number of zones, rings, and sources for phased huygen source model
C
Specify a position vector $r_{k,m,n}$ for each huygen source
D
Determine path length difference $\Delta h(r_{k,m,n})$ to be electromagnetically emulated at each position
E
Determine desired phase shift $\emptyset(r_{k,m,n})$ from path length differences $\Delta h(r_{k,m,n})$
F
Select an electromagnetically loading structure having parameters, e.g. $L_d$, $W_d$
G
Select design parameters, e.g. t, $w_d$, $d_g$
H
Determine dipole length versus desired phase shift characteristic $L_d(r_{k,m,n})$ vs. $\emptyset(r_{k,m,n})$
I
Generate a table for $L_d(r_{k,m,n})$ vs. $r_{k,m,n}$ where $1 \le k \le K$; $1 \le m \le M$; and $1 \le n \le N$
J
Select design parameters
$L_d(r_{k,m,n})$
K
For selected values of design parameters
(1) t;
(2) $W_d$;
(3) $L_d(r_{k,m,n})$
(4) $\epsilon$
(5) $d_g$;
et al.;
Manufacture a candidate microwave phasing structure
L
Test candidate microwave phasing structure to determine actual performance parameters thereof $\{P_i^*\}$
M
Analyze desired and actual performance parameters in light of $L_d$ table and re-adjust values therein, and repeat steps I-M
$\{P_i\}$
$\{P_i^*\}$

MICROWAVE PHASING STRUCTURES FOR ELECTROMAGNETICALLY EMULATING REFLECTIVE SURFACES AND FOCUSING ELEMENTS OF SELECTED GEOMETRY

FIELD OF INVENTION

The present invention relates generally to methods and apparatus for reflecting and focusing electromagnetic radiation within the microwave frequency band, and more particularly, to methods and apparatus for achieving the same utilizing principles of reflection, and electromagnetic loading within support matrices, such as dielectric substrates, having thicknesses on the order of fractions of the wavelengths of the electro-magnetic waves being reflected and/or focused.

BACKGROUND OF THE INVENTION

It is desirable in many applications involving the transmission and reception of microwave signals, to alter the direction of travel of a microwave signal by introducing a reflector into its path. In the case where the reflector is flat, the reflective surface acts in a manner analogous to a mirror in that an incident microwave signal is reflected in accordance with the law of optics. In designing curved reflecting surfaces which enable the concentration or focusing of incident microwaves, optical theory can be applied in a reliable manner, the reason being that microwaves, on a large scale, are propagated in straight lines and, like light waves, microwaves undergo reflection, refraction, diffraction, and polarization.

One particular example of applying optical theory in the design of curved reflecting surfaces, is found in the parabolic antenna. The theory of operation of the parabolic reflector antenna can be most easily explained by the use of ray tracing theory.

As illustrated in FIG. 1, if a microwave transmitter is placed at an infinite distance from a parabolic reflector, then the microwaves which reach the reflector are parallel. Due to the parabolic geometry of the reflecting surface, the parallel beam of microwave radiation is reflected through its focus. Conversely, since all reflection processes are reciprocal, the parabolic reflector will produce a parallel microwave beam if the source of microwave radiation is placed at its focus.

As in the case of the parabolic reflector where reflecting (i.e., focusing) all the incident microwaves towards a single point (i.e., focal point) is required, the reflecting surface must be properly curved. This process of focusing the microwaves, not only requires that the microwaves are reflected in the proper direction towards the focus point, but also that all the reflected microwaves arrive at the focus at the same time, which is commonly referred to as arriving or being "in phase".

In a reflector antenna, such as a parabolic reflector, proper "phasing" of the reflected microwaves is accomplished by ensuring that the distance travelled, or path length, of each incident microwave signal transmitted from the transmitter to the focal point, is identically the same. Where this criterion is not satisfied, "phase distortion" of the incident microwave signals occurs, posing serious reception problems in nearly all instances. In fact, this criterion is so essential that the equation defining the geometries of parabolic reflectors are often based on the criterion, calling for equalized path lengths. This concept is illustrated in FIG. 2.

In some instances where space limitations require that the shape of the parabolic reflector be altered from its characteristic geometry, several prior art techniques are known by which the path length of incident waves can be equalized to satisfy the above-mentioned path length criterion.

Utilizing a known optical design technique, the parabolic reflector of FIG. 2 can be emulated by using the antenna configuration of FIG. 3. Therein, a flat plate reflector is shown on which a dielectric "lens" is mounted in order to provide the desired path length compensation using the principle of refraction.

In the antenna configuration of FIG. 3, the overall thickness of the reflector-dielectric lens assembly is substantially similar to that of the parabolic reflector which it emulates, although the curvature of the dielectric lens is different.

One approach to reducing slightly the thickness of the dielectric lens employed in the prior art path length compensation technique, could involve the use of a Fresnel type lens which approximates the optical and geometrical characteristics of any particular dielectric lens. Methods for making such types of lenses can be found, for example, in U.S. Pat. Nos. 3,739,455 and 3,829,536 to Alvarez and 4,643,752 to Howard et al.

However, while the use of Fresnel lens can reduce slightly the thickness of dielectric lenses employed as path length compensation devices, the resulting microwave device suffers from serious drawbacks and shortcomings. In particular, the resulting surface of the dielectric lens is restricted primarily to planar surfaces and cannot conform to any arbitary surface, as would be desired. Also, manufacturing of such dielectric lens is time consuming and expensive, and the resulting surfaces are prone to collect undesirable airborne matter. In addition, the resulting structures lack the degree of ruggedness and durability required in many applications.

Thus, one of the major problems with such designs is that physical configuration of reflectors cannot be made substantially thinner than the curved reflector antenna configuration sought to be emulated using path length compensation techniques known in the art, and without the aforedescribed shortcomings and drawbacks.

It is desirable, therefore, to achieve reflection of microwave signals in a manner characteristic of curved reflector antennas while achieving the same using an antenna structure which is substantially thinner than curved reflector antennas sought to be emulated using path length compensation techniques (i.e., dielectric lens) known hitherto.

Moreover, it is desirable in some applications to achieve reflection of microwave signals in a manner characteristic of curved reflector antennas, using reflector antenna configurations that may be made to conform with other arbitrary curved surfaces, such as, for example, an airframe surface, and still provide a desired reflective surface of a selected geometry, e.g., a parabolic surface.

In some applications, it is also desirable to achieve focusing of microwave signals in a manner characteristic of curved refractive lens while achieving the same using an antenna structure which is substantially thinner than curved refractive lens sought to be emulated using known path length compensation techniques.

Accordingly, it is a primary object of the present invention to provide an electrically thin microwave phasing structure for electromagnetically emulating a desired reflective surface of selected geometry over an operating frequency band.

The desired reflective surface can be of any geometry, including parabolic surfaces, and geometry of the microwave phasing structure can be made to conform to any arbitrary surface, including planar surfaces.

It is another object of the present invention to provide such a microwave phasing structure, the overall thickness of which can be less than the fraction of the wavelength of the operating frequency of the microwave phasing structure.

It is a further object of the present invention to provide an electronically passive phase delay mechanism of an electrically thin configuration, mountable onto the surface of a reflector, which can be flat, for purposes of equalizing the path lengths of incident microwaves to a focal point, by providing an electronically introduced phase shift thereto as it is being reflected, in contrast with effecting path length compensation based on principles of refraction. The inventive concept of the present invention can be applied provided that Maxwell Equations are applicable.

A further object of the present invention is to provide a method for electromagnetically emulating a desired reflective surface of selected geometry over an operating frequency range, using an electrically thin microwave phasing structure.

It is a further object of the present invention to provide an electrically thin microwave phasing structure for electromagnetically emulating a desired microwave focusing element of selected geometry.

An even further object of the present invention is to provide a method of focusing electromagnetic waves using the microwave phasing structure of the present invention.

A further object of the present invention is to provide a method of shaping radio frequency (RF) energy which greatly increases the configuration flexibility of reflector antenna designs.

The concept of another object of the present invention, is to provide methods of manufacturing electrically thin microwave phasing structures for electromagnetically emulating desired reflective surfaces and focusing elements of selected geometry.

Other and further objects of the present invention will be explained hereinafter, and will be more particularly delineated in the appended claims, and other objects of the present invention will be apparent to one with ordinary skill in the art to which the present invention pertains.

SUMMARY OF THE INVENTION

In accordance with the present invention, a microwave phasing structure is provided for electromagnetically emulating (i.e. imitating the performance of) a desired reflective surface of selected geometry over an operating frequency band.

In general, the microwave phasing structure comprises a support matrix and reflective means for reflecting microwaves with the operating frequency band. The reflective means is supported by the support matrix, which can be virtually any material having dielectric properties and which provides for the propagation of electromagnetic radiation impinging thereon. An arrangement of electromagnetically-loading structures is also supported by the support matrix. The electromagnetically-loading structures are dimensioned, oriented and interspaced from each other and disposed at a distance from the reflective means by said support matrix, so as to provide the desired reflective surface of selected geometry.

More particularly, the microwave phasing surface of the preferred embodiment comprises a dielectric substrate having a first side and second side. On the first side of the dielectric substrate, the reflective means is disposed for reflecting microwaves within the operating frequency band. The arrangement of electromagnetically-loading structures is disposed on the second side of the dielectric substrate. The electromagnetically-loading structures are dimensioned, oriented and interspaced from each other and disposed at a distance from the reflective means so as to provide the desired reflective surface of selected geometry.

In the preferred embodiment, the reflective means is a reflective layer of metallic material, and the dielectric substrate is a substantially planar sheet of low loss dielectric material. However, in accordance with the present invention, the reflective means can be a dichroic surface which is reflective to incident electromagnetic waves within the operating frequency band, and transparent to all other frequencies lying outside the operating frequency band.

In the preferred embodiment, the arrangement of electromagnetically-loading structures comprises an array of metallic patterns, each metallic pattern having a cross (i.e., X) configuration whose dimensions, orientation, and interspacing from each other are such that the desired reflective surface of selected geometry is obtained. Each metallic pattern constitutes a shorted crossed dipole.

The selected geometry of the desired reflective surface can be a parabolic surface to provide a parabolic reflector wherein all path lengths of the reflected incident electromagnetic waves are equalized by phase shifting effected by the microwave phasing structure of the present invention.

A principle advantage of the present invention is that the "electrically thin" microwave phasing structure of the present invention can be made as thin as a fraction of the wavelength of the operating frequency of the phasing surface, thereby electromagnetically emulating desired reflective surfaces regardless of the geometry of the physical surfaces to which the electrically thin microwave phasing structure is made to conform. As used hereinafter, the term "electrically thin" shall mean on the order of a fraction of the wavelength of the operating frequency of the microwave phasing structure.

Another advantage of the electrically thin microwave phasing structure of the present invention is that curved reflective surfaces of any geometry can be emulated electromagnetically using a substantially planar microwave reflector antenna configuration.

Accordingly, this feature of the present invention enables the realization of curved (e.g., parabolic) reflective surfaces using physical antenna configurations which can be virtually arbitrary, thereby facilitating the installation of reflector antennas where space and weight limitations, or where physical conditions such as turbulent air flow (on for example, an airframe) would otherwise prevent such installations, or render it highly undesirable to do so. In short, the electromagnetic shaping (i.e., focusing) technique greatly increases the configuration flexibility of reflector antenna designs, in particular.

Another advantage of the electrically thin microwave phasing structure of the present invention is that a parabolic reflective surface as of the type commonly employed in roof-mounted microwave dish antennas, can be electromagnetically emulated using a substantially planar embodiment of the electrically thin microwave surface hereof. This advantage provides great promise for the construction and installation on rooftops, of substantially flat lowprofiled microwave reflector antenna configurations employing the microwave phasing surface of the present invention, eliminating the eyesore nature of prior art microwave "dish" antennas.

Another aspect of the present invention concerns an electrically thin microwave phasing structure for electromagnetically emulating a desired focusing element of selected geometry over an operating frequency band. The microwave phasing structure comprises a dielectric substrate having a first side and a second side, and a thickness which can be less than a fraction of the wavelength of the highest frequency within the operating frequency band. On the first side of the dielectric substrate, a first arrangement of electromagnetically-loading structures is disposed. On the second side of the dielectric, a second arrangement of electromagnetically loading structures is disposed. Each electromagnetically-loading structure of the first and second arrangements is dimensioned, oriented and interspaced from each other and disposed at a distance from each other, to provide the desired focusing element of selected geometry.

In the preferred embodiment, the dielectric substrate is substantially planar and the geometry of the desired focusing element is of a plano-parabolic converging lens having a focal point, wherein all path lengths to the focal point are phase equalized.

A principal advantage of the electromagnetically emulated microwave focusing element hereof is that incident electromagnetic waves (within the operating frequency band of the microwave phasing structure) can be focused using, for example, a substantially planar ultra-thin structure, wherein path lengths of the incident electromagnetic waves to the focal point of the focusing element are electronically phase equalized without requiring the use of conventional dielectric lens for path length compensation.

Also, the electrically thin microwave phasing structure for electromagnetically emulating a microwave focusing element can be made to conform to an arbitrary surface, such as that of an airframe or the like. Thus using this embodiment of the present invention, incident electromagnetic waves transmitted from a source located far away can be focused to a focal point within an airframe, at which a detector of a receiver can detect the same in a manner known in the art without the internal installation of a parabolic reflector antenna as is customary in the microwave communication arts.

The present invention also concerns a method of manufacturing microwave phasing structures for electromagnetically emulating desired reflective surfaces and focusing elements of selected geometry.

In the instance of electromagnetically emulating desired reflective surfaces, the method of manufacturing the microwave phasing structure comprises providing a dielectric substrate having a reflective means disposed on one side thereof and an arrangement of electromagnetically-loading structures disposed on the other side. At least one geometry for the electromagnetically-loading structures is selected, but more than one may be desired in certain circumstances. The dimensions, orientation and interspacing of the selected electromagnetically-loading structures and distance from the reflection means, are determined in order to provide emulation of the desired reflective surface of selected geometry. The electromagnetically-loading structures having dimensions, orientation and interspacing from each other as determined in the above step, are then provided on the other side of the dielectric substrate, whereby the microwave phasing structure is formed.

In the preferred embodiment, the dimensions, orientation and interspacing of the selected electromagnetically-loading structures can be determined by constructing on a computer-aided design system, a three-dimensional ray tracing (i.e., path length) model of the microwave phasing surface and the desired reflective surface of selected geometry. From the three-dimensional ray model, the dimensions, orientation and interspacing of the selected electromagnetically-loading structures are computed to provide the desired reflective surface of selected geometry. In providing the other side of the dielectric substrate with the determined arrangement of electromagnetically-loading structures (each having a metallic pattern), a metallic layer can be formed on the other side of the dielectric substrate. A composite pattern corresponding to the determined arrangement of electromagnetically-loading structures is generated. Portions of the metallic layer can be removed, using in the preferred embodiment a photo-etching process, thereby leaving remaining therein the generated composite pattern corresponding to the arrangement of electromagnetically-loading structures.

In manufacturing the electrically thin microwave phasing structures for electromagnetically emulating desired focusing elements of selected geometry, a method similar to the method of manufacture hereinabove described can be employed.

DESCRIPTION OF THE DRAWINGS

For a further understanding of the objects of the present invention, reference is made to the following detailed description of the preferred embodiment which is to be taken in connection with the accompanying drawings, wherein:

FIG. 7A is a perspective view of a three-dimensional phased Huygen-Source array model of an electrically thin microwave phasing structure for electromagnetically emulating desired reflective surfaces of selected geometry, constructed in accordance with the principles of the present invention;

FIG. 7B is a cross sectional view of the phased Huygen-Source array model shown in FIG. 7A, illustrating a loaded transmission line model for each phased Huygen-Source and the path lengths $L_1$, $L_2$, and $L_3$ which are used to compute the corrective phase shift for each Huygen-Source;

FIG. 9 is a flow chart illustrating the steps involved in the preferred embodiment of the method of designing an electrically-thin microwave phasing structure in accordance with the principles of the present invention;

DETAILED DESCRIPTION OF THE PREFERRED EMBODIMENT

Figure 1:
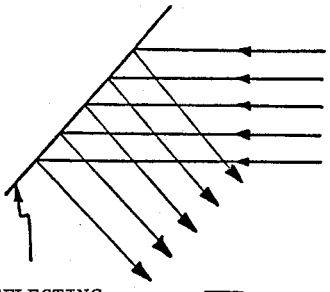
Fig. 1 (PRIOR ART)
FIG. 1 is a schematic diagram illustrating the reflection of plane incident electromagnetic waves from a planar reflective surface.
Figure 2:
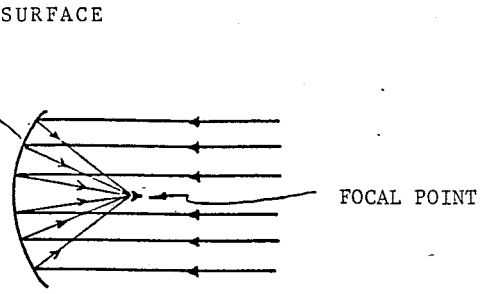
Fig. 2 (PRIOR ART)
FIG. 2 is a schematic diagram of a parabolic reflector antenna configuration depicting equal path length of focused incident electromagnetic waves.
Figure 3:
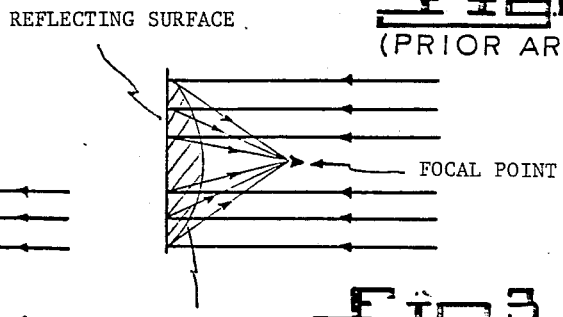
Fig. 3 (PRIOR ART)
FIG. 3 is a schematic diagram of a dielectric lens reflector antenna employing a dielectric lens mounted onto a flat plate reflector to provide desired path length compensation.
Figure 4:
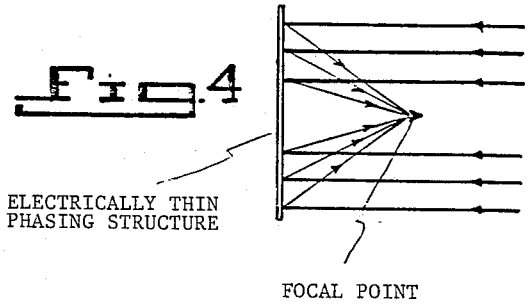
FIG. 4 is a schematic diagram of an electromagnetically emulated parabolic reflector antenna employing the electrically thin microwave phasing structure constructed in accordance with the principles of the present invention.

Referring to FIGS. 4 and 7B, in particular, a flat reflector antenna structure is shown embodying an electrically thin microwave phasing structure constructed in accordance with the principles of the present invention. Therein, the microwave phasing structure of the preferred embodiment comprises a dielectric substrate 10, having on one side 11 (for convenience referred to as the "first side") a reflective means 12, which in the preferred embodiment is a metallic layer. The metallic layer 12 is for reflecting microwaves within the operating frequency band of the microwave phasing structure hereof, but may reflect other frequencies as well without undesirable consequences. Regarding the dielectric substrate 10, a suitable insulative or dielectric material, such as Teflon®, can be used.

On the second side 14 of the dielectric substrate, an arrangement of electromagnetically-loading structures 16 are disposed. In accordance with the principles of the present invention, the electromagnetically-loading structures are dimensioned, oriented and interspaced from each other, and disposed from the metallic reflective layer 12 at a distance which can be less than a fraction of the wavelength of the highest frequency within the operating frequency band, as to provide the reflective surface of a parabolic reflector. These distances will be further specified hereinafter.

The dielectric substrate 10 functions as a support matrix and is not essential to the present invention. Accordingly, instead of a dielectric substrate, a micromesh-like grid structure could be used as a support matrix, on which the reflective means and electromagnetically-loading structures can be supported.

In the preferred embodiment, the electromagnetically-loading structures 16 comprise an array of metallic patterns, each metallic pattern being in the form of a cross (i.e., X) configuration. Notably, however, each electromagnetically-loading structure can be formed of different geometrical patterns, and, in fact, could be shorted crossed dipoles, metallic plates, irises, apertures, etc. Examples of various known electromagnetically-loading structures which may be used in providing the electrically thin microwave phasing structure of the present invention, can be found in U.S. Pat. Nos.

4,656,487; 4,126,866; 4,125,841; 4,017,865; 3,975,738; and 3,924,239.

Attention is now accorded to the general principles governing the dimensions, orientation and interspacing of the electromagnetically-loading structures 16 disposed on the second side of the dielectric substrate 10, and the effects that such design parameters as well as the distance between the electromagnetically-loading structures 16 and the metallic reflective layer 12, have upon the resulting geometry of the electromagnetically emulated reflective surface.

In order to more fully appreciate the microwave phasing structures of the present invention and provide physical insight in to the complicated microwave propagation phenomenon occurring within the dielectric substrate thereof, a brief review of the physical principles underlying the same shall be discussed at this juncture. With this objective in mind, it will be revealing to consider the propagation (i.e., transmission, reflection and phase shifting) of electromagnetic waves (i.e., microwaves) entering and exiting the electrically thin microwave phase structure.

Referring to FIGS. 7A and 7B, a discussion is now given describing how the microwave phasing structure of the present invention provides an electronically-passive phase delay mechanism using an electrically-thin planar configuration, for the purposes of equalizing the path lengths of incident plane microwaves and reflecting the same towards a focal point in the preferred embodiment.

In the preferred embodiment of the present invention, path length equalization and desired reflection of incident plane waves towards a focal point is achieved by the electrically-thin planar configuration of FIG. 4, which electronically introduces desired degrees of phase shift to the microwaves at each small "local" region on the planar structure. It is the interaction between the electromagnetically-loading structures 16, the dielectric substrate 10, and the metallic reflective layer 12, in the presence of an incident electromagnetic wave, which causes the incident wave to be reflected toward the focal point and arriving there in such a way that electromagnetic phases of each reflected wavefront is equal. In such a case, the reflected wavefronts arriving at the focal point are said to be "in phase".

Each electromagnetically-loading structure 16 is positioned from its neighboring electromagnetically-loading structures, at a distance $d_g$ which is approximately equal to one-half the wavelength of the operating frequency $f_o$ of the microwave phasing structure. This spacing, in effect electromagnetically decouples one electromagnetically-loading structure from another, renders the mathematical analysis and modelling simpler, and most significantly, allows each electromagnetic-loading structure to be considered a "Huygens-Source", i.e., a decoupled electromagnetic structure having a resonant frequency, and emanating a spherical wavefront.

The present invention contemplates the concept of a Huygens-Source which can be derived from Huygens' principle, which states that every point on a wavefront may be considered as a secondary source of secondary wavelets which combine to form succeeding wavefronts. Thus, if the position of a wavefront at any instant is known, a simple construction enables its position to be drawn at any subsequent time.

It has been discovered that each electromagnetically-loading structure of the present invention, upon being excited by an incident plane wave, will emanate a spherical wavefront, on which each and every point may be considered as a source of secondary wavelets which combine to form succeeding wavefronts in accordance with the Huygens principle.

With each electromagnetically-loading structure 16 considered as a Huygen-Source, the entire arrangement of such structures can therefore be represented by a phased Huygens-Source Array model, as illustrated in FIGS. 7A and 7B. Notably, each Huygen-Source is characterized by a resonant frequency and a phase shift measured from a reference, such as the reflective layer 12. The mechanism by which the plurality of spherical wavefronts (with predetermined phase-shift) are reflected towards the focal point, is by the process of superposition of waves of the same or substantially the same frequency.

In order to understand how each electromagnetically-loading structure (i.e., Huygen Source) emanates a spherical wavefront with the required degree of phase shift, it will be helpful to now discuss the nature of wave propagation between each electromagnetically-loading structure 16 and the reflective layer 12, which combination can be considered an independent, decoupled, electromagnetically resonant structure, wherein a predetermined phase shifting occurs in an electronically passive manner.

Referring to FIG. 7B in particular, each electromagnetically-loading structure and reflective layer pair, is modelled as a loaded transmission line having a respective impedance $Z(r_{k,m,n})$. The impedance of each electromagnetically resonant structure can be characterized as a function of the physical size of each individual electromagnetically-loading structure, the thickness and composition of the dielectric substrate, and the nature of the reflective surface (i.e., the ground plane). Thus, the resonant frequency for each electromagnetically resonant structure can be determined by forming a relationship between the above parameters.

Figure 5:
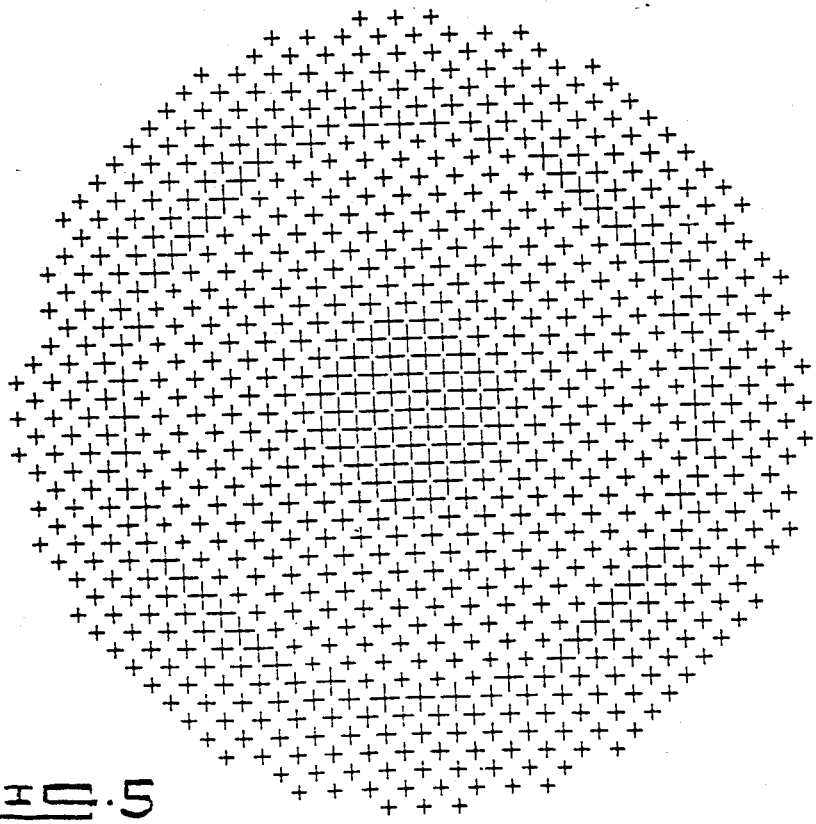
FIG. 5 is a plan view of the preferred embodiment of the microwave phasing structure of the present invention, showing the utilization of an array of cross-shaped dipole elements, as the electromagnetically-loading structures of the microwave phasing structure, arranged in accordance with a hybrid Polar-Cartesian coordinate system.

Referring to FIG. 5, it is noted that the dimensions of the electromagnetically-loading structures differ for electromagnetically-loading structures located at different positions on the microwave phasing structure. This difference in the physical size of the electromagnetically-loading structures 16 in conjunction with the electrical properties of the dielectric substrate 10 and the reflective layer 12, which are in close proximity to the electromagnetically-loading structures 16, causes each electromagnetically resonant structure formed thereby to become electrically resonant at some electromagnetic frequency.

As can be clearly illustrated in FIG. 7B in particular, upon being excited by an incident electromagnetic wave, each electromagnetic loading structure 16, considered as a Huygens-Source, radiates back towards the reflective layer 12, a spherical wavefront. According to principles of physics, as each spherical wavefront propagates towards and reflects from the reflective layer 12, each spherical wavefront undergoes a predetermined phase shift (to be discussed hereinafter in greater detail) and thereafter emanates from its respective electromagnetically-loading structure 16, as a phase-shifted spherical wavefront.

By adjusting the physical size of each electromagnetically-loading structure, desired resonant frequencies can be produced which may differ from those employed in the desired operating frequency band. This is most significant in the design of the electrically thin microwave phasing surface of the present invention, as the impedance $Z(r_{k,m,n})$ of (and thus phase shift caused by) a typical radiating element 16 varies as the frequency of the incident excitation wave is changed away from the resonant frequency of its respective electromagnetically resonant structure.

According to well known properties of electromagnetically resonant structures, the impedance $Z(r_{k,m,n})$ of an electromagnetically-loading structure 16 will be purely resistance having zero reactance when it is excited by an incident electromagnetic wave having a frequency exactly equal to the designed resonance frequency of the electromagnetically resonant structure. Consequentially, no phase shift will result in an electromagnetic wave as it emanates from the electromagnetically-loading structure 16 in the direction of the focal point of the microwave phasing structure. However, as the frequency of the incident electromagnetic wave is changed to a frequency either higher or lower than the resonant frequency of the electromagnetically resonant structure, then the impedance thereof becomes reactive, and thus will cause a phase shift in the incident electromagnetic wave as it emanates away from the electromagnetically-loading structure towards to the focal point.

Therefore, by adopting in the preferred embodiment a transmission line model for wave propagation through each electromagnetically resonant structure formed by the aforedescribed structures and properties, the impedence of each electromagnetically resonant structure provides desired "reactive loading" upon its respective Huygens-Source. It is the reactive loading which results in an electromagnetic phase shift of the spherical wavefront which emanates from the Huygens-Source. Accordingly, it therefore becomes proper to represent the electrically-thin microwave phasing structures of the present invention as an array of phased Huygens-Sources as illustrated in FIGS. 7A and 7B.

With the foregoing in mind, it now becomes understandable that in order to achieve the focus or reflection of an incident electromagnetic wave, the present invention teaches in general, locally introducing a shift $\Delta\phi(r_{k,m,n})$ in the phase of incident electromagnetic wave energy to correct (i.e., "phase equalize") the path length difference, $\Delta\phi(r_{k,m,n})$, of all portions of the incident wave. Also, the present invention teaches in particular, that such desired path length corrections can be achieved by selectively shifting the phases $\Delta\phi(r_{k,m,n})$ of all of the portions of the incident electromagnetic wave. In the preferred embodiment, such selective phase shifting is achieved by the proper physical placement $r_{k,m,n}$ of individual electromagnetically-loading structures of the proper physical size $L_d(r_{k,m,n})$, at a distance from a reflective layer 12 (i.e., ground plane). Such an arrangement, in effect, forms within an electrically-thin configuration, an array of electromagnetically resonant structures having desired impedences with respect to the operating frequency band of the microwave phasing structure, at respective locations.

By referring to the phased Huygen-Source Array model of FIG. 7A, the operation of the electromagnetically emulated parabolic reflector of the present invention can be described as follows. In particular, the model of FIG. 7A illustrates the applied principle of phased spherical wavefront superposition. Upon exciting the arrangement of electromagnetically-loading structures 16 with an incident electromagnetic plane wave, each particularly dimensioned, interspaced, and positioned electromagnetically-loading structure 16 radiates back towards the reflective layer 12, a spherical wavefront. Each spherical wavefront propagates towards the reflective layer 12 through its decoupled, electromagnetically resonant structure (which is modelled as a loaded transmission line having impedence Z). Upon reflection, the spherical wavefront propagates towards its respective electromagnetically loading structure 16 (e.g., crossed shorted dipole) and emanates therefrom with a predetermined electromagnetic phase shift $\Delta\phi(r_{k,m,n})$ in accordance with its principles of the present invention.

Thus, taken as a composite wave propagation process, the array of phased Huygen-Sources simultaneously produces, in response to incident plane wave radiation, a plurality of phased spherical wavefronts over the operating frequency range, which by processes of wave superposition and constructive and destructive interference, provides desired focusing of electromagnetic waves towards the focal point of the flat microwave phasing structure. Notably, this electromagnetic energy focusing process passively occurs in an electrically-thin structure as if the incident electromagnetic waves were actually being focused by a reflector having the desired geometry of a structure being electromagnetically emulated.

In carrying out the present invention, a computer aided design (hereinafter CAD) system can be employed to construct a three-dimensional ray, phased Huygen-Source array, or hybrid model of the electrically-thin microwave phasing structure of the present invention.

Notably, construction of the ray model can be instrumental in computing the dimensions, orientation, and interspacing of the electromagnetically-loading structures in order to provide a desired reflective surface of selected geometry such as of a parabolic reflector having a focal point, wherein all path lengths of incident microwaves 20 to the focal point 18 are "phased equalized" upon reflecting from the microwave phasing structure of the present invention as illustrated in FIG. 7B. In addition, the three-dimensional ray model can be useful in representing actual as well as electromagnetically emulated path lengths, in general, and "phase equalizing" the path lengths in particular. In contrast, the Huygens-Source array models of FIG. 7A and FIG. 12 can be useful in computer simulating the electromagnetic phasing and wavefront interference process caused by the interaction of an incident electromagnetic wave and the electrically-thin microwave phasing structure of the present invention.

Using a phased Huygen-Source array model, the net focused beam of electromagnetic wave energy can be modelled (and thus the focal point determined) by computer simulating an array of phased Huygen-Source generators, each having a predetermined resonant frequency and a corresponding phase shift measured, for example, with respect to the reflective layer (i.e., ground plane). Alternatively, a hybrid model comprising both three-dimensional ray tracing and phased Huygen-Source arrays, can be constructed as well, having of course the benefits of both such modelling techniques.

Figure 6A:
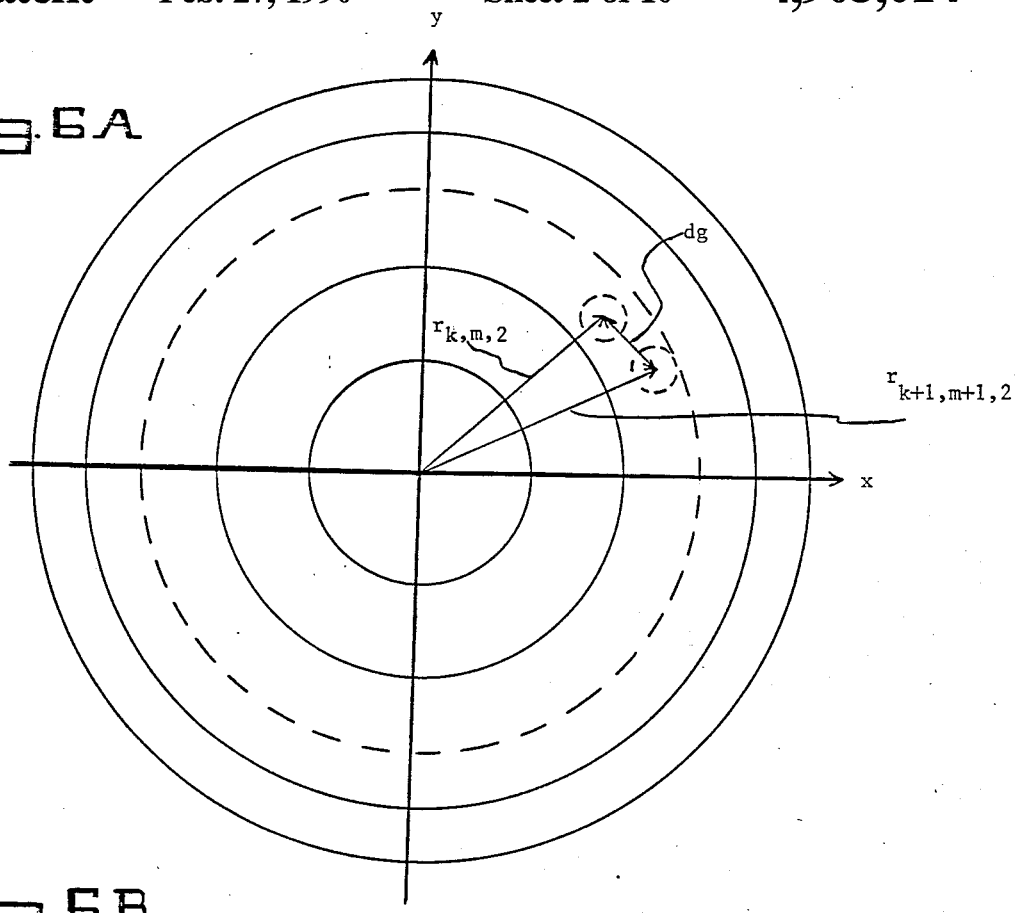
FIG. 6A is a graphical representation of a pair of electromagnetically-loading structures of the microwave phasing structure shown in FIG. 5, illustrating the positioning, dimensions, and interspacing of the electromagnetically-loading structures in accordance with a polar coordinate system in a Fresnel zone framework.
Figure 6B:
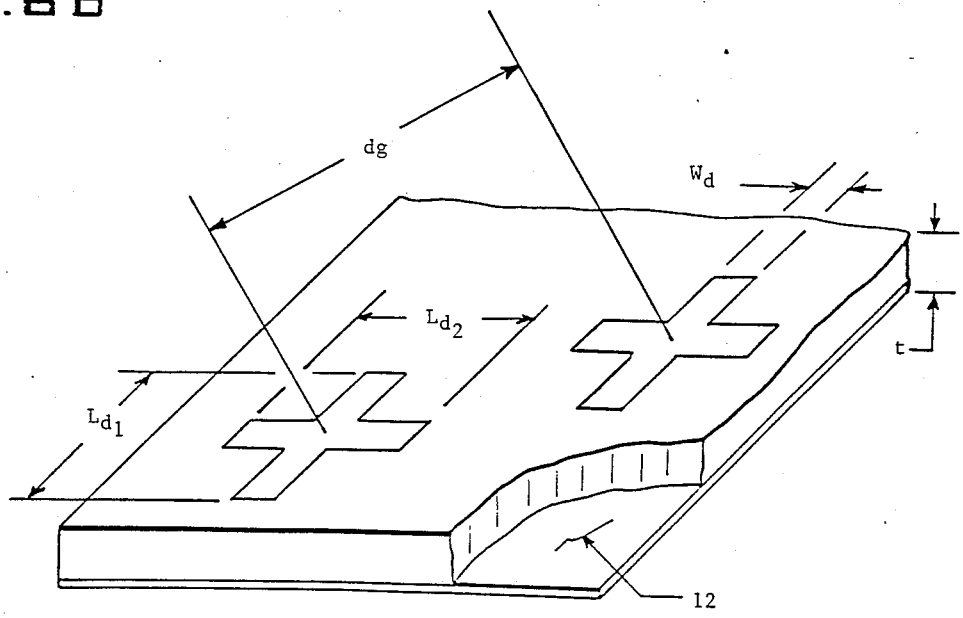
FIG. 6B is a perspective view of a section of the microwave phasing structure of FIG. 5, showing a pair of electromagnetically-loading structures and illustrating the design parameters which specify the dimensions, interspacing of the same, and their distance from the reflective means.
Figure 11A:
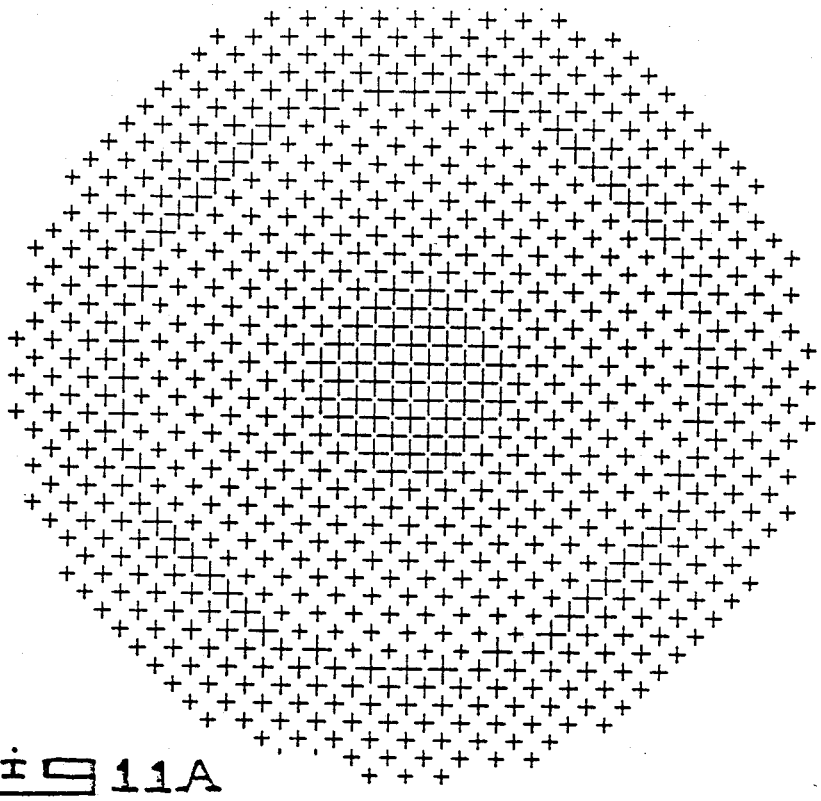
FIGS. 11A and 11B are a plan view of the first and second sides respectively, of an electromagnetically emulated microwave focusing element employing an electrically-thin microwave phasing structure, constructed in accordance with the principles of the present invention.
Figure 11B:
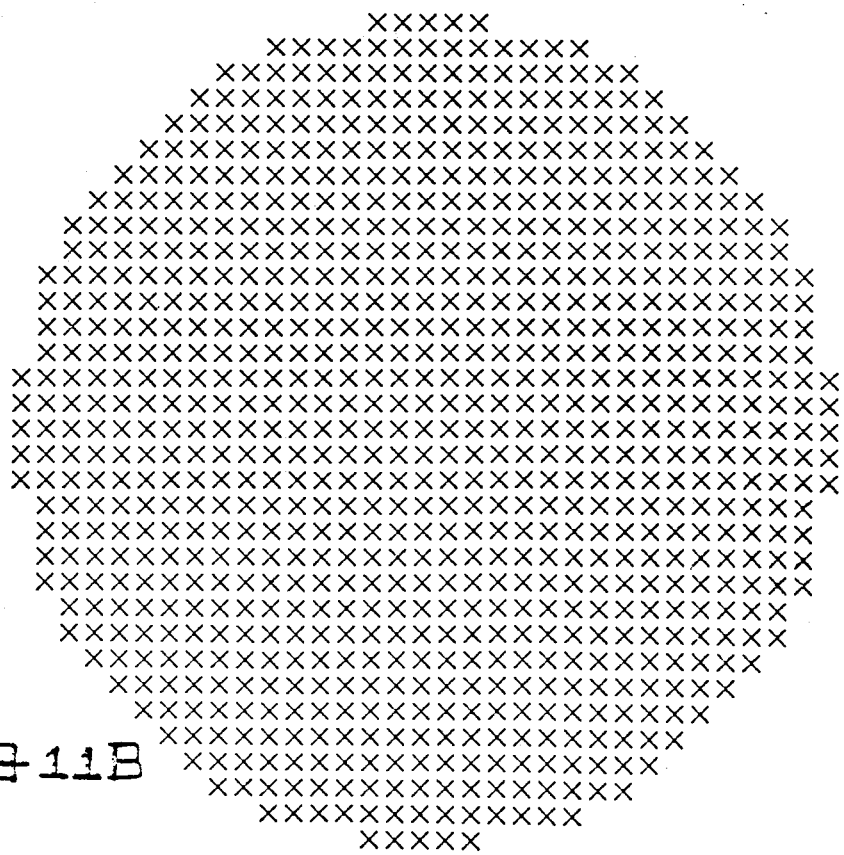

Electrical design parameters of the microwave phasing surface hereof are illustrated in FIG. 6B, and are used in specifying the models of FIGS. 7A, 7B, 12 and 13. In the case of the symmetric "crossed dipole element" employed in the microwave phasing structures of FIG. 5 and FIGS. 11A and 11B, such design parameters can include:

(1) the length of the first dipole element at position $r_{k,m,n}$, denoted by $L_{d1}(r_{k,m,n})$;

(2) the length of the second dipole element at position $r_{k,m,n}$ denoted by $L_{d2}(r_{k,m,n})$;

(3) the width of the first dipole element at position $r_{k,m,n}$ denoted by $W_{d1}(r_{k,m,n})$;

(4) the width of the second dipole element at position $r_{k,m,n}$ denoted by $W_{d2}(r_{k,m,n})$;

(5) the spacing between the electromagnetically-loading structure and the reflective means (i.e. "ground spacing") denoted by t;

(6) the interspacing between neighboring electromagnetically-loading structures (herein assumed equidistant) denoted by $d_g$;

(7) the operating frequency of the electrically-thin microwave phasing structure denoted by $f_o$;

(8) the operating wave length of the electrically-thin microwave phasing structure, denoted by $\lambda_o$;

(9) the operating band width of the electrically-thin microwave phasing structure $\Delta f_o$;

(10) the resonant frequency for the electromagnetically resonant structure formed between the reflective means and an electromagnetically-loading structure positioned at $r_{k,m,n}$, denoted by $f_o(r_{k,m,n})$;

(11) the electromagnetic phase of each electromagnetically resonant structure (i.e., Huygen-Source) at position $r_{k,m,n}$, denoted by $\phi(r_{k,m,n})$;

(12) the electromagnetically emulated path length at position $r_{k,m,n}$, as measured from the reflective means to the respective position on the surface to be electromagnetically emulated, denoted by $h(r_{k,m,n})$;

(13) the quality factor of each electromagnetically resonant structure at position $r_{k,m,n}$, denoted by $Q=F(L/W)$;

(14) the permitivity of the support matrix (e.g., the dielectric substrate) denoted by $\epsilon$; and

(15) the impedence of the electromagnetically resonant structure at position $r_{k,m,n}$, denoted by $Z(r_{k,m,n})$, where $1 \leqq k \leqq K$, $1 \leqq m \leqq M$, and $1 \leqq n \leqq N$.

In the preferred embodiment, the length of each dipole element of the crossed dipole is the same, (i.e., $L_{d1}=L_{d2}$), and therefore the length of the cross-diple will be hereinafter denoted as $L_d(r_{k,m,n})$. As the width of each dipole element is the same (i.e., $W_{d1}=W_{d2}$), the width of each crossed-dipole will be denoted by $W_d(r_{k,m,n})$.

Each of the above-described design parameters plays a particular role with respect to the design of an electrically-thin microwave phasing surface.

In particular, the length of the crossed dipole $L_d(r_{k,m,n})$ controls the resonant frequency $f_o(r_{k,m,n})$ of each electromagnetically resonant structure (i.e., Huygen-Source). In the preferred embodiments, the range of dipole length is $0.25\lambda_o \leqq L_d(r_{k,m,n}) \leqq 0.75\lambda o$.

The width $W_d(r_{k,m,n})$ of each dipole element controls the band width of each electromagnetically resonant structure (i.e., phased Huygens-Source). In the preferred embodiment, the width parameter $W_d$ lies with the range $0.01\lambda o \leqq W_d \leqq 0.1\lambda o$.

The spacing t between the electromagnetically-loading structures and the ground plane (i.e., reflective means) for the flat reflector embodiment, controls the band width over which phasing can be achieved. In the preferred embodiment, the spacing falls within the range $\lambda o/_{16} \leqq t \leqq \lambda o/_4$.

The ratio of dipole length $L_d(r_{k,m,n})$ to the width of dipole $W_d(r_{k,m,n})$, controls what will be referred to as the "Quality Factor" of the phased Huygen-Source at position $r_{k,m,n}$. Analogous to the concept "quality factor" used in electrical circuit response and analysis, the term "quality factor" used hereinafter will refer to the sharpness of the frequency response function of each electromagnetically resonant structure (i.e., Huygens-Source). Thus, phased Huygen Sources having a high "quality factor" means that they emanate a band of electromagnetic waves having most of the power centered at and closely about its resonant frequency. A low quality factor, on the other hand, means that the power of the electromagnetic waves emanated from a phased Huygen-Source is spread out over the band, with the resonant frequency of the phased Huygens-Source not having much more power than adjacent frequencies on either sides of the resonant frequency.

The center-to-center distance e.g., $d_g(r_{m,n}, r_{k+l,m,n})$ between the electromagnetically-loading structures is adjusted to decouple neighboring electromagnetically resonant structures (i.e., phased Huygens-Sources) from one another, and thereby simplify the mathematical analysis. This parameter is not critical, and can be adjusted during the design process, thereby providing some design flexibility. In the preferred embodiment, the range of the center-to-center distance $d_g$ of neighboring electromagnetically-loading structures is $0.4\lambda_o \leqq d_g \leqq 0.6\lambda o$.

The permitivity of the dielectric substrate (i.e., support matrix) is representative of the medium's capability of (i) storing charge per unit space, and (ii) support an electric field, and should lie within the range $O \leqq \epsilon \leqq 1.0$.

The fundamental operating frequency $f_o$ of the electrically-thin microwave phasing surface, is 35 GHZ in the preferred embodiment, and the operating frequency band typically is 3 to 5 percent of that operating frequency $f_o$. Notably, the operating frequency and frequency band, can vary from embodiment to embodiment and may take on any range of values.

It is appropriate at this juncture to now describe a method of designing an electrically thin microwave phasing structure for electromagnetically emulating a desired reflective surface or focusing element of selected geometry.

Figure 14A:
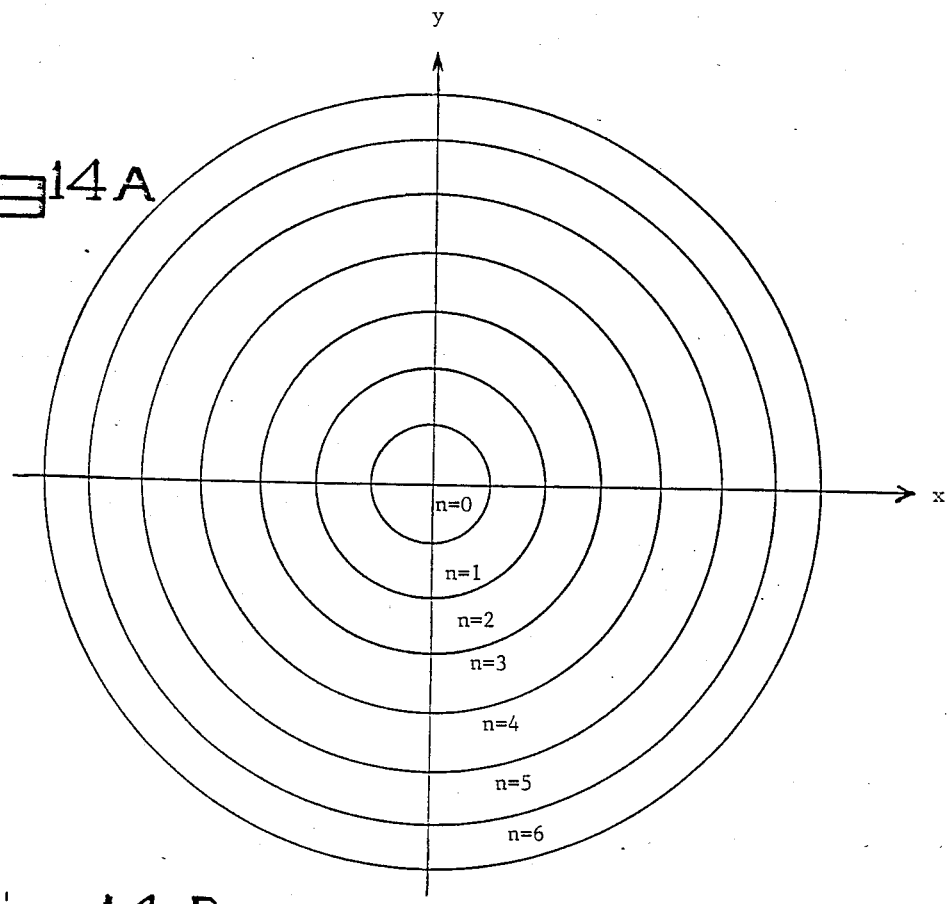
FIG. 14 is a Fresnal zone and ring diagram corresponding to a succession of cencentric surface bands comprising the refractive focusing element electromagnetically emulated by the planar microwave phasing structure illustrated in FIGS. 12 and 13.
FIG. 14B is a graphical diagram illustrating the vertical electromagnetically emulated path length differences that incident parallel plane waves travel from the physical phasing structure to rings on the surface bands of the emulated plano-parablic refractive focusing element of the preferred embodiment.
FIG. 14C is a graphical respresentation of required phase versus the radial distance of each electromagnetically-loaded structure of the embodiment illustrated in FIG. 14B.
Figure 14B:
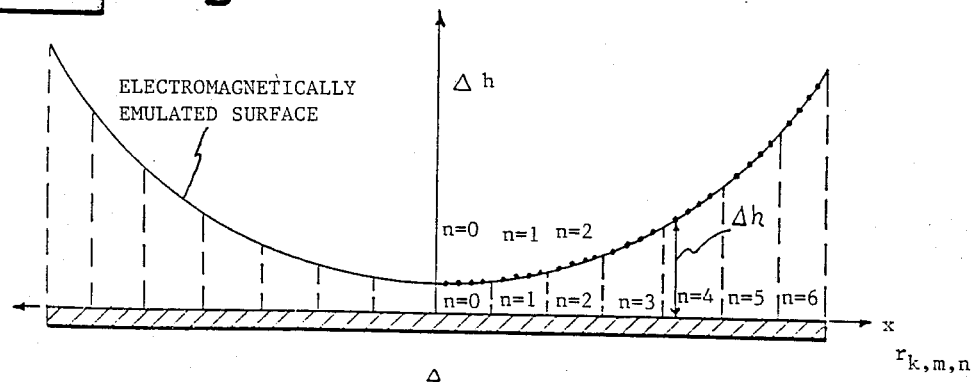

Foremost, a few words regarding notation and position specification must be said. As illustrated in FIGS. 5, 14A and 14B, the electro-electrically thin microwave phasing surfaces of the preferred embodiments has been modelled and designed using a rectangular cartesian coordinate system. However, in FIG. 6A, a polar coordinate system is schematically illustrated for purposes of mathematically modelling the precise position of each electromagnetically-loading structure (e.g., crossed dipole) on the dielectric substrate. Using discrete polar coordinate notation, the position vector r of each electromagnetically-loading structure (i.e., phased Huygen-Source), located in the ring of the Fresnel zone, can be represented as $$r_{k,m,n}$$

where $1 \leqq k \leqq K$, $1 \leqq m \leqq M$, and $1 \leqq n \leqq N$.

In FIG. 6A such N zones, M rings and K positions thereon are schematically illustrated, showing only two electromagnetically-loading structures and the center-to-center inspacing therebetween, but actually, hundreds and sometimes thousands of phased Huygen- Sources are present on a surface, as is shown in FIG. 5 for example. With such notation for position specification, modelling of the microwave phasing structure is simplified.

It has been discovered that in designing any one particular microwave phasing structure for electromagnetically emulating a particular reflective surface, such as a parabolic surface, one of several possible approaches may be used in determining (i) the dimensions and interspacing of the electromagnetically-loading structures, and (ii) other design parameters of the microwave phasing structure.

In the preferred embodiment of the design method, a "Fresnel zone" model is used to model a three-dimensional reflective surface, as a succession of concentric rings, on N-zones of subarrangements of electromagnetically-loading structures (e.g., crossed dipoles), each subarrangement corresponding to a respective element or concentric section of a parabolic reflector. According to the model, each subarrangement of electromatically loading structures is assembled in a proper relationship, on for example a flat surface, to provide a composite electromagnetically emulated reflective surface when excited by an incident plane electromagnetic wave having a wavelength(s) in the operating frequency band $\Delta\lambda$.

Referring now to the flow chart of FIG. 9, and to the graphical representations of 8A, 8B and 8C in particular, a description of the preferred embodiment of the method of designing an electrically-thin microwave phasing according to principles of the present invention, will now be given.

Figure 8A:
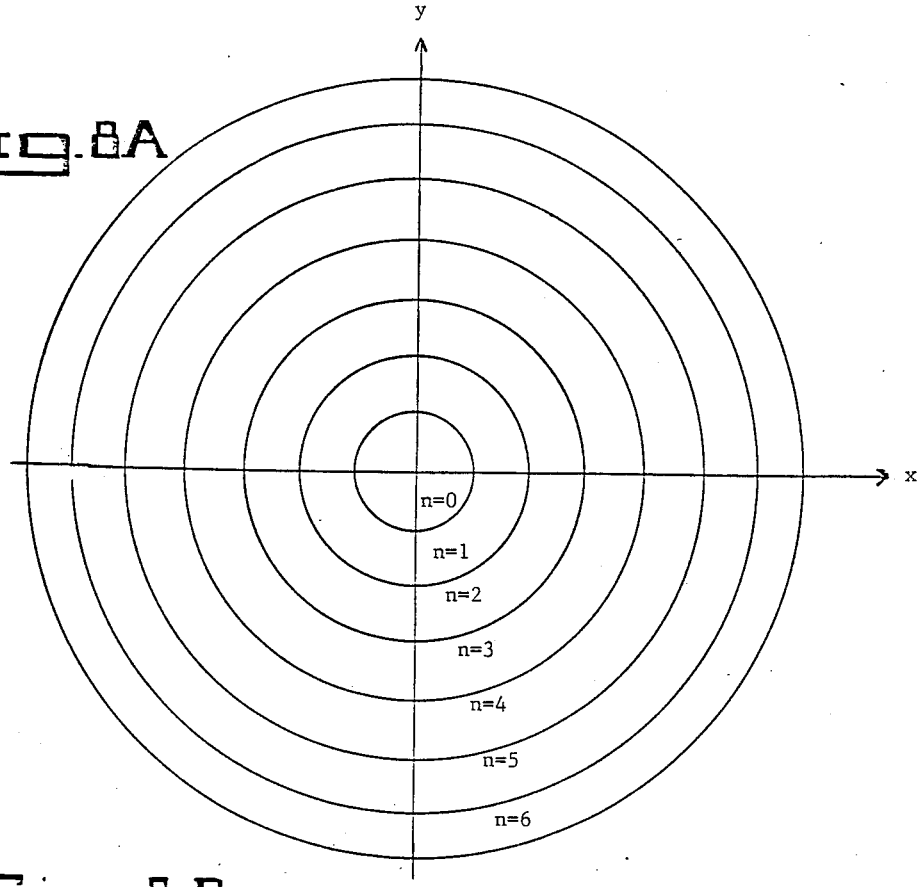
FIG. 8A is a Fresnal zone and ring diagram corresponding to the succession of concentric surface bands comprising the reflective surface electromagnetically emulated by the microwave phasing structure of the preferred embodiment.
Figure 8B:
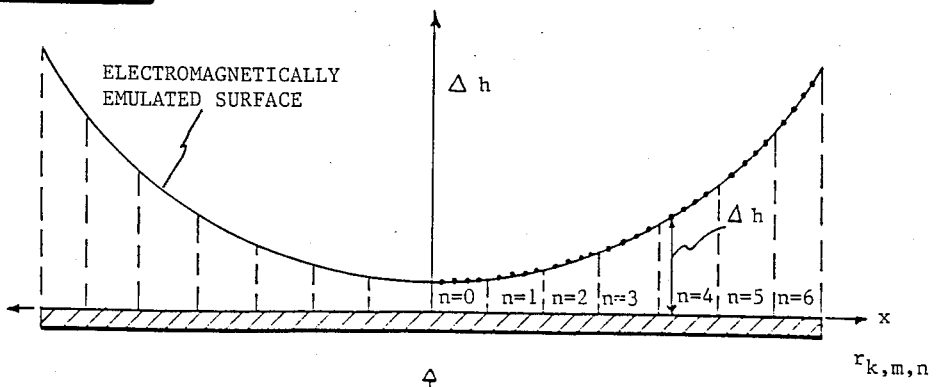
FIG. 8B is a plot illustrating the vertical electromagnetically emulated path length differences that incident parallel plane waves travel from the rings on the surface bands of the emulated reflective surface, to the physical reflective means (i.e., ground plane) of the microwave phasing structure, measured as a function of radial distance away from the center axis.
Figure 8C:
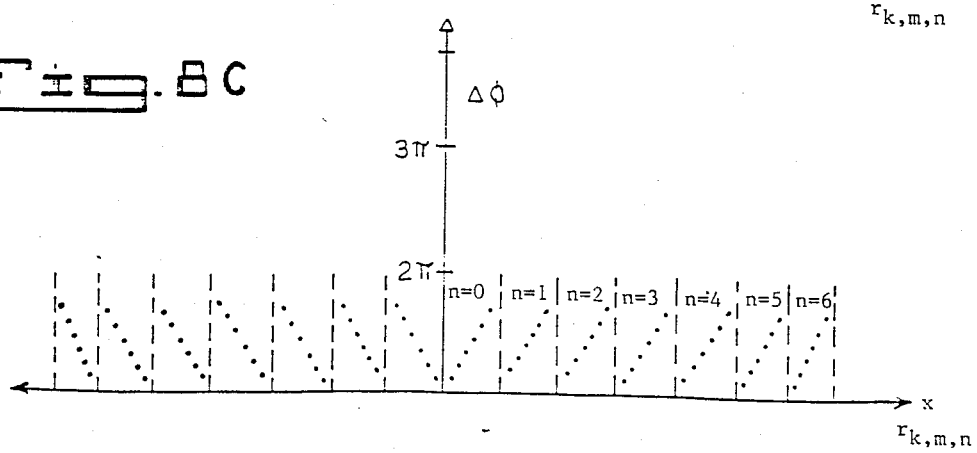
FIG. 8C is a graphical representation of required phase versus the radial distance of each electromagnetically-loading structure of the embodiment illustrated in FIG. 8B.
Figure 8D:
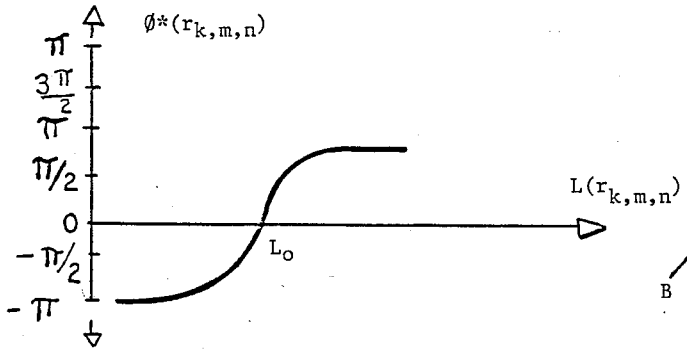
FIG. 8D is a graphical diagram illustrating the empirically determined characteristic showing measured phase shift versus the length of the crossed-dipoles of the microwave phasing structure of the preferred embodiment.

The flow chart of a design method is shown in FIG. 9, and can be described by referring to FIGS. 8A, 8B, and 8D, in particular, where three "spatially aligned" graphical representations of N-Fresnal zone model are illustrated. In the preferred embodiment, a parabolic reflective surface will be used as an example for describing the preferred embodiment of the antenna design method. Thus, Zone 6 of FIG. 8A corresponds to the outermost concentric section of the parabolic surface, whereas Zone 0 corresponds to the apex thereof.

The first step of the design method involves specifying (i) the physical surface of the microwave phasing structure configuration, and (ii) the reflective surface to be electromagnetically emulated therewith. Typically, this step could involve constructing a three-dimensional surface model for the reflective surface to be emulated and the physical surface, using a suitable computer-aided design system known in the art. In the preferred embodiment, the physical surface will be a planar surface.

In the preferred embodiment, where the electromagnetically emulated reflective surfaces and focusing elements possess circular symmetry, the three-dimensional surface model is sectioned into concentric surface elements, whose projection onto the x-y plane determines the radial dimensions of the zones illustrated in FIG. 8A.

FIG. 8B shows a graphical plot of the to-be-electromagnetically emulated path length difference, $\Delta h$, using a planar (i.e., physically flat) microwave phasing structure. For each locus of positions $r_{k,m,n}$ where $1 \leqq k \leqq k$, $1 \leqq m \leqq M$ and $1 \leqq n \leqq N$, the electromagnetically emulated path length difference $\Delta h(r_{k,m,n})$ therefrom to the ground plane (i.e., reflective layer 12) is plotted versus radial distance away from the center axis. It is the physical path length difference $\Delta h(r_{k,m,n})$ which must be electromagnetically-emulated by the electrically thin microwave phasing surface upon reflection (or transmission) of an incident electromagnetic wave.

In the preferred embodiment of the present invention, the approach taken involves (i) computing path length differences $\Delta h(r_{k,m,n})$ for each Huygen-Source, using path lengths $l_1$, $l_2$, $l_3$ defined in FIG. 7B, and (ii) converting each path length difference $\Delta h(r_{k,m,n})$ into a corresponding phase shift $\phi(r_{k,m,n})$ through which a plane incident electromagnetic wave must undergo during the reflection/phase-shifting (or transmission/-phase-shifting) process.

By referring to FIG. 7B in particular, the path length difference herein defined as $\Delta h(r_{k,m,n})$ between each electromagnetically loading structure 16 and the focal point of the electrically-thin phasing structure, can be determined as follows. By definition, the desired path length from focal point to a point, $P_1$, on the surface to be emulated, is represented by $L_1$; the actual path length from point $P_1$ to a point, $P_2$, on the electrically-thin phasing structure is represented by $L_2$, and the actual path from point $P_2$ to the focal point is represented by $L_3$.

A general expression for representing the phase corrected path lengths between (i) point $P_1$ on the surface to be emulated and the focal point and (ii) point $P_2$ on the electrically-thin phasing structure and the focal point, is as follows:

$$L_1 + n\lambda_o = L_2 + L_3 + \Delta h$$

where $L_1$, $L_2$, and $L_3$ are as defined hereinabove; $\lambda_o$ is the operating wavelength of the electrically-thin phasing structure; n is an integer; and $\Delta h$ is the corrective path length difference at each local region centered about $r_{k,m,n}$, which is to be electromagnetically emulated by performance of the respective Huygen-Source of the electrically-thin phasing surface of the present invention. From the above expression, the corrective path length difference $\Delta h$ can be expressed in terms of length measure, as follows:

$$\Delta h = L_1 - L_2 - L_3 + n\lambda_o$$

Thereafter, using the expression $$\phi(r_{k,m,n}) = \frac{2\pi\Delta h(r_{k,m,n})}{\lambda_o}$$

the corrective phase shift $\phi(r_{k,m,n})$ can be computed.

A graphical plot of desired phase shift $\phi(r_{k,m,n})$ versus radial distance away from center $r_{k,m,n}$ is illustrated in FIG. 8C. This characteristic of FIG. 8C can be computed from the characteristic shown in FIG. 8B using the relation $\phi(r_{k,m,n}) = 2\pi\Delta h/\lambda o$, and can be used in determining the "desired" phase shift $\phi(r_{k,m,n})$ to be introduced into an incident electromagnetic wave in the "local" region denoted by position vector $r_{k,m,n}$, from which the respective phased Huygens-Source emanates a particularly phased spherical wavefront in the direction of the focal point of the microwave phasing structure.

In order to obtain a dipole length $L_d$ $(r_{k,m,n})$ versus radial distance $r_{k,m,n}$ characteristic which can be used to manufacture a microwave phasing structure of the present invention, it is necessary to determine a characteristic of phase shift $\phi(r_{k,m,n})$ versus the physical dimensions of the selected electromagnetically-loading structure (e.g., dipole length $L_d$). Regardless of how this data is generated (i.e., theoretically or empirically) it nevertheless is an important characteristic with respect to the design method of the present invention, as it establishes a relationship between a required electrical parameter and a variable physical parameter.

In the preferred embodiment, the dipole length $L_d$ versus actual phase $\phi$ characteristic of FIG. 8D is empirically determined after having selected (i) the basic geometry of the electromagnetically-loading structure (e.g., crossed-dipole), (ii) the number of zones, rings and positions to be represented in the phrased Huygen-Source array model, and (ii) other design parameters, except dipole length $L_d$ $(r_{k,m,n})$.

This $L_d$ vs. $\phi$ characteristic will differ from one design of electrically thin microwave phasing structure to another, and is dependent of both the type of electromagnetically loading structure used and the values of the design parameters discussed hereinbefore.

According to this iterative design method, determining an actual phase versus dipole length characteristic for any particular design of microwave phasing structure, involves manufacturing a number of similar "test" microwave phasing structures each having the same zone-ring-position organization of the final desired phasing structure, but with different dipole lengths. The same type of electromagnetically-loading structure (e.g., crossed dipole) is used in manufacturing each "test" phasing structure, and for each "test" phasing structure, each electromagnetically-loading structure should have the same physical dimensions (e.g. dipole length $L_d$). Also, the electromagnetically-loading structures of each "test" phasing surface should be arranged on a dielectric substrate having a thickness that is the same for each "test" phasing structure. Each electromagnetically loading structure preferably should be spaced from neighboring structures to ensure electromagnetic decoupling therebetween, as discussed hereinbefore. Preferably for each test phasing structure, the physical dimension (e.g., $L_d$) of the dipole lengths will be within a parameter range likely to be used in the actual design.

Thereafter, each "test" microwave phasing structure is subject to microwave test instrumentation to measure the actual amount of phase shift $\phi^*$ achieved for each "test" microwave phasing structure having crossed dipoles of identical length. Such phase shift measure can be made, for example, by placing a microwave bridge at some arbitary but stationary reference point in the vicinity of the focal point of the reflector. Notably, what is important is that actual phase shift measurements are made from the same reference point during the design process while using a different "test" microwave phasing structure. This will ensure that relative phase shift measurements are made. Thus, for each microwave phasing structure having crossed dipoles of length $L_d$, actual phase shift (i.e., $\phi^*$) measurements are made, and from a series of such "test" microwave phasing structures, a first approximation characteristic of actual phase $\phi^*$ versus dipole length $L_d$ can be empirically determined.

Figure 8E:
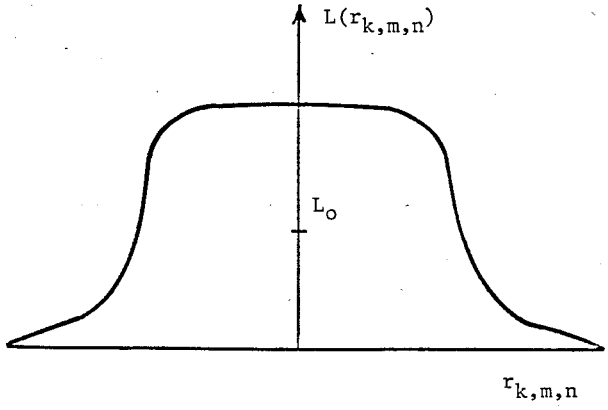
FIG. 8E is a graphical diagram illustrating the dipole length versus radial distance characteristic which is used in the preferred embodiment of the design method of the present invention.

Using (i) the empirically determined phase $\phi^*(r_{k,m,n})$ versus dipole length $L_d(r_{k,m,n})$ characteristic of FIG. 8D and (ii) the desired phase $\phi(r_{k,m,n})$ versus radial distance $r_{k,m,n}$ characteristic of FIG. 8C, a theoretical yet a first approximation characteristic of dipole length $L_d$ versus radial distance $r_{k,m,n}$ as shown in FIG. 8E, can be determined. This first approximation dipole length versus radial distance characteristic is then used to manufacture "a first approximation" microwave phasing structure for electromagnetically emulating the desired parabolic reflective surface.

The first approximation microwave phasing structure is then subject to conventional microwave test instrumentation to determine actual performance parameters $\{P^*_i\}$ such as focal point position, beam width, gain, frequency response, reflectance characteristics and the like.

Based on the measurement of such performance parameters, some or all of the theoretical design parameters may be adjusted to achieve the desired performance.

Accordingly, a desired microwave phasing structure can be achieved through the hereinabove described iterative design process involving (i) the production of several "approximate" microwave phasing structures (each having a different set of dipole lengths $L_d(r_{k,m,n})$; (ii) comparing desired antenna performance parameters $\{P^*_i\}$ with those actually achieved using the array of approximate dipole lengths $L_d(r_{k,m,n})$; and (ii) readjusting the dipole length values $L_d(r)$ in view of the actual antenna performance parameters $\{P^*_i\}$ obtained.

While only the preferred embodiment of the design method hereof has been described, there are, however, alternative methods for determining the specifications of an arrangement of electromagnetically-loading structures, in order to provide the emulation of a desired reflective surface (or focusing element) of selected geometry. One alternative method may involve, for example, the evaluation of subsections (i.e., elements) of the emulated surface independently from each other, so as to optimize them. Then the surface subsections are joined or superimposed to emulate the complete surface or focusing element.

Referring now to FIGS. 11A, 11B, 12, and 13, in particular, attention is given to another aspect of the present invention involving the use of the electricaly thin microwave phasing structure described hereinbefore.

Figure 13:
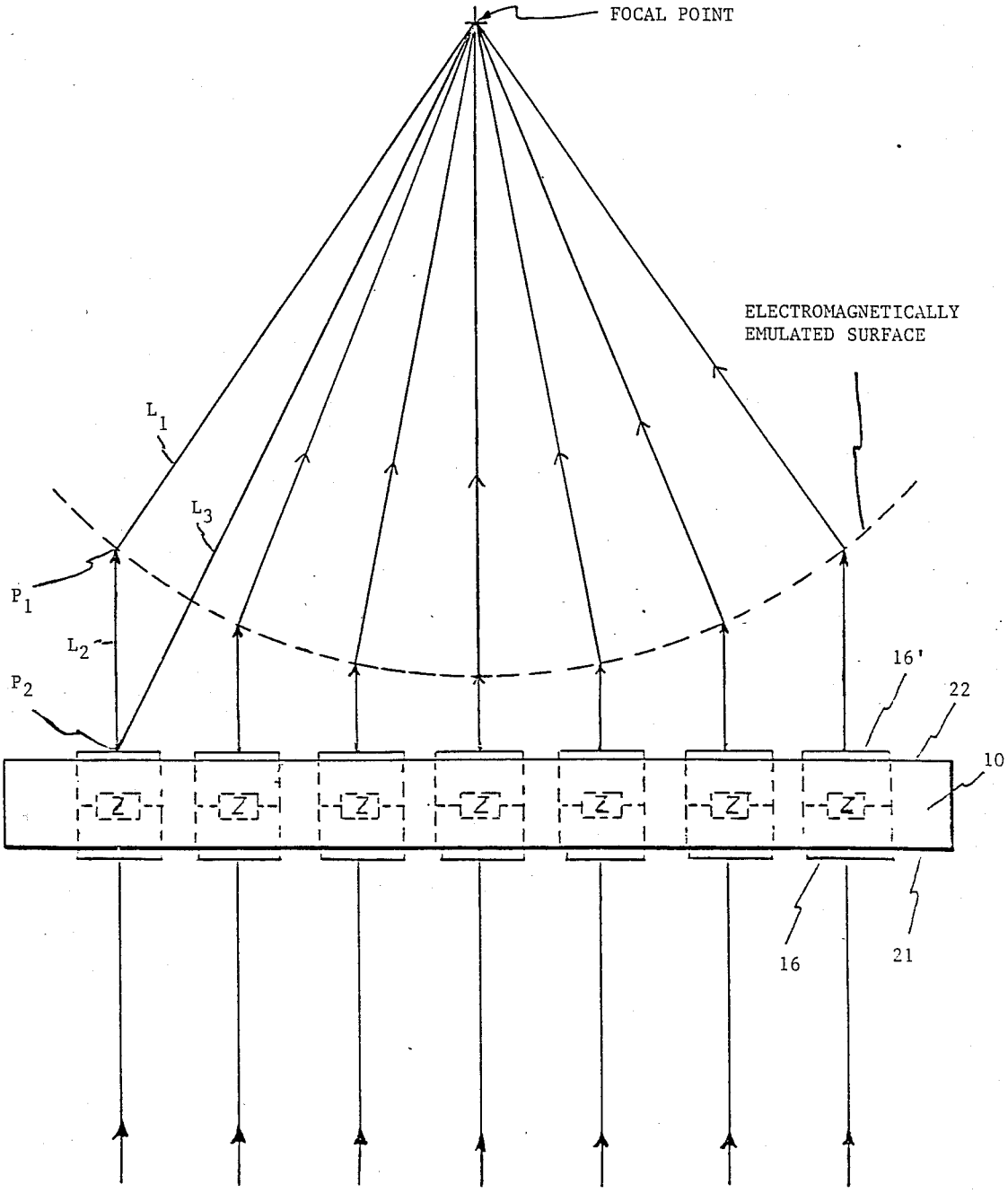
FIG. 13 is a cross section view of the phased Huygen-Source model shown in FIG. 12, illustrating a loaded transmission line model for each phased Huygen-Source thereof and the path length difference $\Delta h$ which determines the phase shift provided by each Huygen-Source.

FIG. 13, in particular, provides a schematic representation of an electrically thin microwave phasing structure for electromagnetically emulating a desired microwave focusing element of selected geometry over an operating frequency band. The microwave phasing structure of FIG. 13 comprises a planar dielectric substrate 10 having a first side 21, a second side 22, and a thickness which can be as small as a fraction of the wavelength of the operating frequency of the operating band. On the first side 21 of the dielectric substrate 10, first arrangement of electromagnetically-loading structures 16 are disposed, and on the second side 22 thereof, a second arrangement of electromagnetically-loading structure 16' are disposed. In accordance with the principles of the present invention, the electromagnetically-loading structure 16 are dimensioned, oriented and interspaced from each other as to provide the desired emulation of the microwave focusing element of selected geometry.

As with the microwave phasing structure described hereinbefore in connejction with the reflector antenna structure hereof, the electromagnetically-loading structure 16 of the preferred embodiment comprises an array of metallic patterns wherein each metallic pattern is in the form of a cross (i.e., X) configuration, but can in principle by realized by different geometrical patterns, and in fact, could be dipoles, metallic plates, irises, apertures, etc., as discussed hereinbefore.

In carrying out this aspect of the present invention, a computer-aided design system can be employed to construct a three-dimensional ray (and/or phased Huygens-Source array) model of the microwave phasing structure for electromagnetically emulating a desired microwave focusing element of selected geometry.

In FIG. 13, a phased Huygen-Source Array model is illustrated for the microwave phasing structure for emulating desired focusing elements of selected geometry. Analogous to the model illustrated in FIG. 7A, this model can serve to represent the phase delay mechanism of the present invention as well as the interference process resulting from an array of phased Huygen-Sources emanating phased spherical wavefronts, as discussed hereinbefore.

The method used to design the preferred embodiment of this aspect of the present invention is, in principle, very similar to the design method hereinbefore described.

Figure 12:
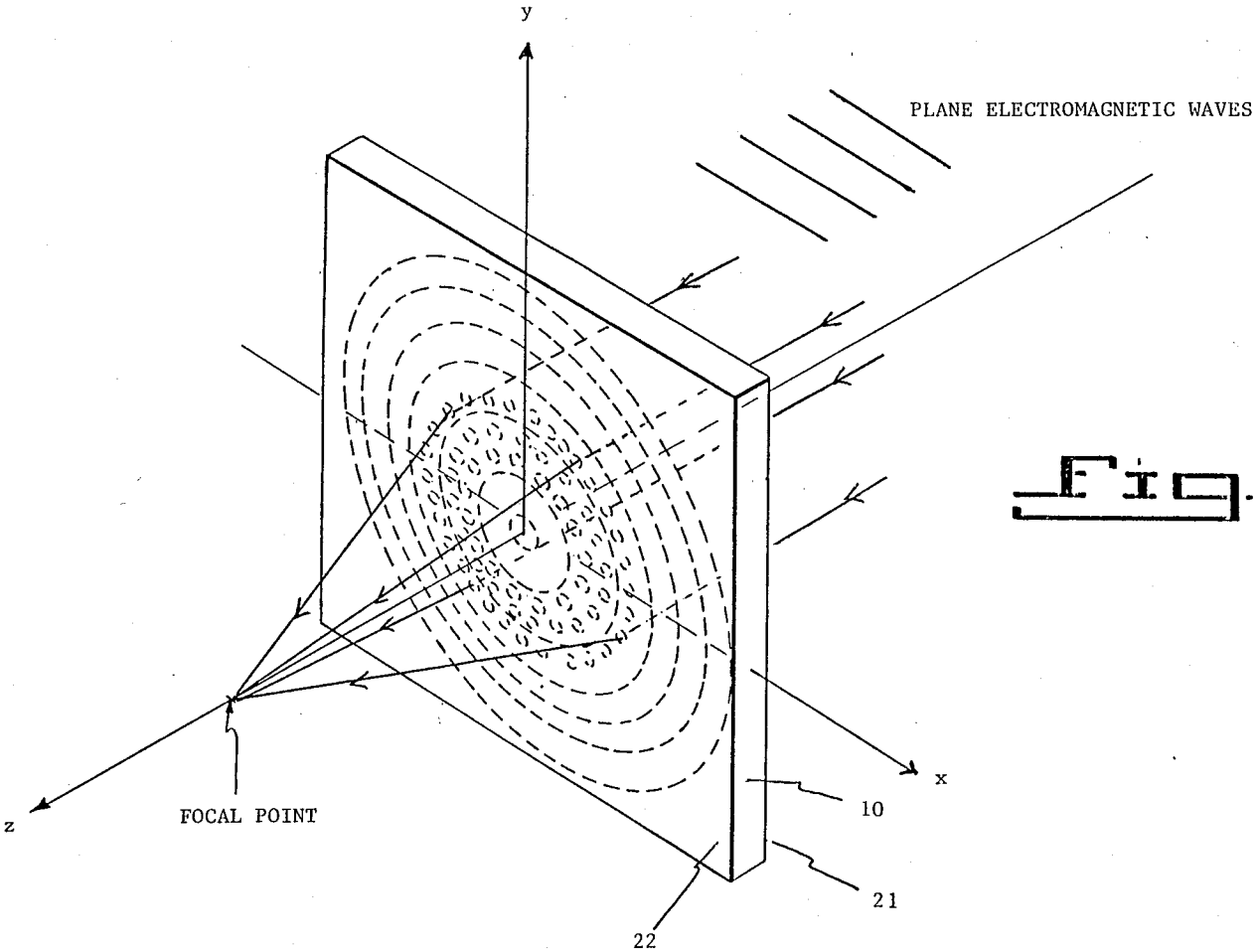
FIG. 12 is a perspective view of a three-dimensional phased Huygen-Source Array model of the electrically thin microwave phasing structure of FIGS. 11A and 11B, for electromagnetically emulating a desired microwave focusing element of selected geometry, constructed in accordance with the principles of the present invention.

FIG. 14B, analogous to FIG. 8B, illustrates the path length corrections which are needed to electromagnetically emulate a plano-parabolic refractive focusing element using a planar microwave phasing structure of the present invention. The principle difference between the two principal embodiments described herein, is that, as illustrated in FIGS. 12 and 13, each electromagneticaly resonant structure is formed between corresponding spaced electromagnetically-loading structures on first and second sides of the dielectric substrate, and not between an electromagnetically-loading structure and the reflective means 12. Notably, however, each electromagnetically resonant structure can be represented by a loaded transmission line model as illustrated in FIG. 13 and as discussed in detail hereinbefore.

Figure 14C:
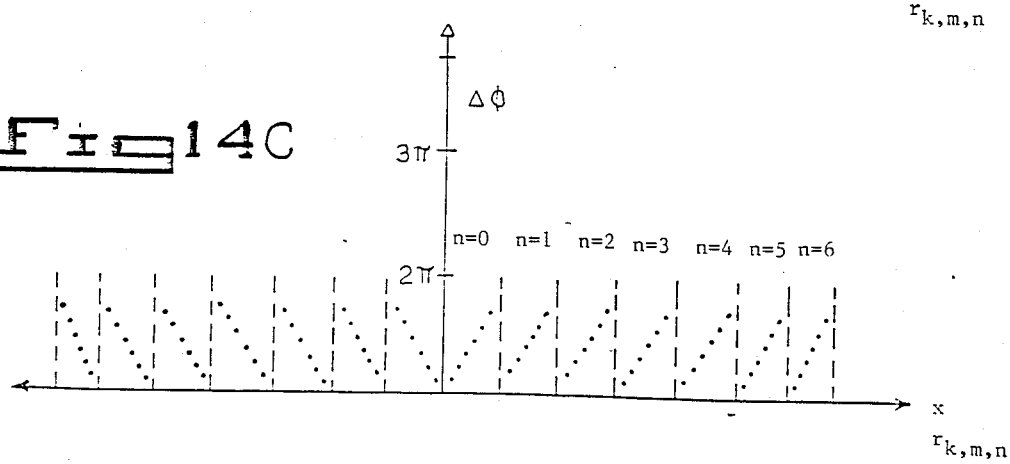

Accordingly, FIGS. 14A, 14B, and 14C which correspond to FIGS. 8A, 8B and 8C respectively, function in the design method as do FIGS. 8A, 8B and 8C.

As with the previously described design method, the length of each electromagnetically loading structure (e.g., crossed dipole) of the first arrangement must be determined. However, in this embodiment, the length of the corresponding loading structure must also be determined. As described hereinbefore, an actual phase shift versus dipole length characteristic as illustrated in FIG. 8D, can be empirically determined. In this particular embodiment, the geometry and dimensioning of each corresponding electromagnetically-loading structure (e.g., crossed-dipole) pair are preferably identical. Thus, from such a phase shift versus dipole length characteristic and the desired phase shift versus radial distance characteristic of FIG. 14C, a first approximation dipole length versus radial distance characteristic can be determined. In accordance with the principles of the reiterative design process described hereinbefore, a final dipole length versus radial distance characteristic can be derived, and in combination with the other selected design parameters, the desired microwave phasing structure can be manufactured.

Figure 10:
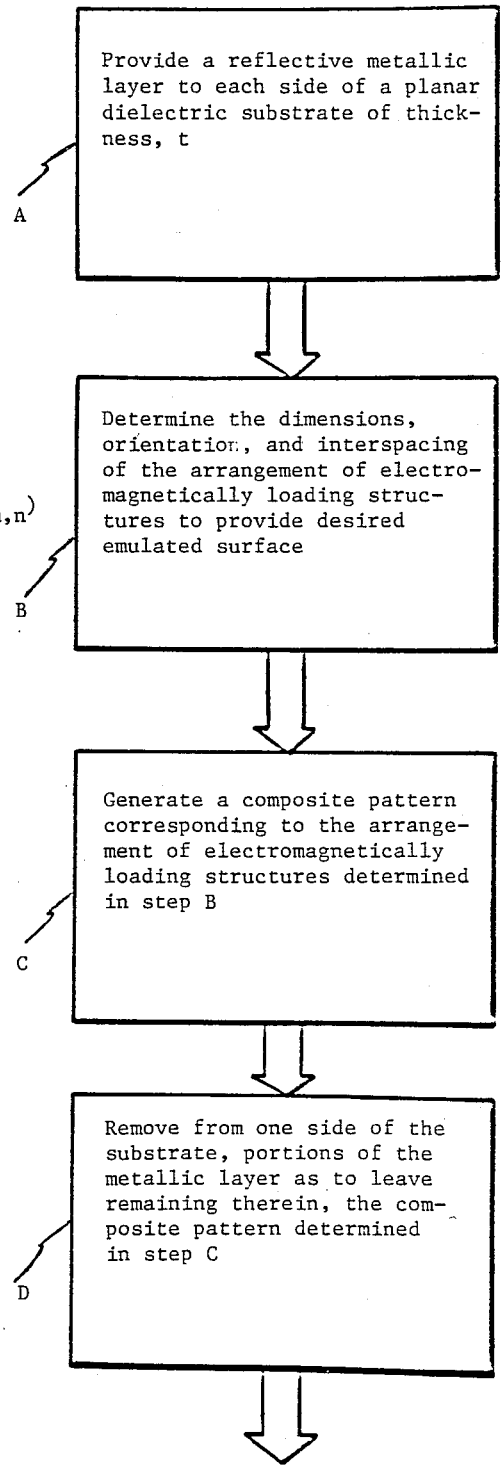
FIG. 10 is a flow chart illustrating the steps involved in the preferred embodiment of the method of manufacturing an electrically-thin microwave phasing surface in accordance with the principles of the present invention.

For exemplary purposes, a method will now be descried for manufacturing the electrically thin microwave phasing structure for electromagnetically emulating a desired reflective surface of selected geometry. Referring to the flow chart of FIG. 10, the method of manufacturing the microwave phasing structure includes providing a dielectric substrate 10 having a reflective means disposed on one side 12 thereof. The arrangement of electromagnetically-loading structures 16 having dimensions, orientation and interspacing from each other as determined by the hereinbefore described design process, are then provided to the other side 14 of the dielectric substrate 10, whereby the microwave phasing structure is formed.

In providing to the other side 14 of the dielectric substrate 10 the determined arrangement of electromagnetically-loading structures (each having a metallic pattern), a metallic layer is first provided to the other side 14 of the dielectric substrate 10. A composite pattern corresponding to the determined arrangement of electromagnetically-loading structures is generated using computer-aided design methods and apparatus known inthe art. Portions of the metallic layer are then removed using in the preferred embodiment a photoetching process, as to leave remaining therein, the generated composite pattern corresponding to the determined arrangement of electromagnetically-loading structures.

In manufacturing the microwave phasing structures for electromagnetically emulating desired focusing elements of selected geometry, a method similar to the method of manufacture hereinabove described can be employed with modifications which will hereinafter be apparent to those with ordinary skill in the art.

An apparent modification of the present invention would be the use of a dichroic structure for the reflective means (e.g., layer) 12 of the electrically thin microwave phasing structure hereof. The advantage of this modification would be that over the operating frequency range of the microwave phasing structure, the dichroic structure would have a sufficiently high low-loss reflectivity, and for frequencies outside this range, a high transmitivity. Ideally, the arrangement of electromagnetically-loading structures 16 could be also designed to provide transmitivity to electromagnetic wave energy outside the operating frequency band, thereby allowing essentially unattenuated transmission of particular bands of electromagnetic energy through the microwave phasing structure, while providing a desired electromagnetically emulated reflective surface to microwave within the operating frequency band. Examples of dichroic structures suitable for the reflective means of the microwave phasing surface of the present invention can be found in U.S. Pat. Nos. 4,656,487, 4,126,866, 4,017,865, 3,975,738, and 3,924,239, in particular.

It is expected that the microwave phasing structure of the present invention can be applied in a variety of other ways. For example, it can be used in the decoy and radar deception arts as well. In such applications, arbitrary air-frame surfaces can bear the microwave phasing surface in order to electromagnetically emulate desired reflective surfaces of selected geometry. Notably, these emulated surfaces could function in a variety of ways.

Thus, on one hand, the microwave phasing surface could be used to deceive a tracking radar as to the actual motion of an object bearing the microwave phasing structure of the present invention on its surface. On the other hand, the microwave phasing structure of the present invention could be used to make surfaces having a particular physical geometry, appear to have a different geometry to incident electromagnetic waves within its operating band.

While the particular embodiments shown and discussed hereinabove have proven to be useful in many applications, further modifications of the present invention hereindisclosed will occur to persons skilled in the art to which the present invention pertains, and all such modifications are deemed to be within the scope and spirit of the present invention defined by the appended claims.

What is claimed is:

1. A microwave phasing structure for electromagnetically emulating a desired reflective surface of selected geometry over an operating frequency band, which comprises:

(a) a support matrix;

(b) a reflective means for reflecting microwaves within said operation frequency band, said reflective means supported by said support matrix; and (c) a phasing arrangement of electromagnetically-loading structures supported by said support matrix and generally being resonant at some frequency outside of said operating frequency band, said electromagnetically-loading structures varying in dimension and having an orientation and interspacing from each other and being disposed at a distance from said reflective means by said support matrix so as to provide said emulation of said desired reflective surface of selected geometry.

2. The microwave phasing structure of claim 1 wherein said reflective means is a metallic reflecting layer.

3. The microwave phasing structure of claim 1 wherein said desired reflective surface is a curved surface.

4. The microwave phasing structure of claim 1 wherein said support matrix is substantially planar.

5. The microwave phasing structure of claim 4 wherein said electromagnetically-loading structures comprise an array of metallic patterns.

6. The microwave phasing structure of claim 5 wherein each metallic pattern of said array comprises a cross configuration, each said cross configuration varying in dimension and having an orientation and interspacing from each other, and being disposed at a distance from said reflective means by said support matrix so as to provide said emulation of said desired reflective surface.

7. The microwave phasing structure of claim 4 wherein said desired reflective surface comprises a parabolic reflector having a focal point and wherein all path lengths to said focal point are phase equalized.

8. The microwave phasing structure of claim 7 wherein said reflective means comprises a metallic reflective layer.

9. The microwave phasing structure of claim 1 wherein said operating frequency band is in the range of from about 0.1 GHZ to about 300 GHZ.

10. The microwave phasing structure of claim 1 wherein the geometry of said support matrix is substantially non-planar, and said desired reflective surface is curved.

11. The microwave phasing structure of claim 10 wherein said electromagnetically-loading structures comprise an array of metallic patterns.

12. The microwave phasing structure of claim 10 wherein each metallic pattern of said array comprises a cross configuration, each said cross configuration varying in dimension and having an orientation and interspacing from each other and being disposed at a distance from said reflective means by said support matrix so as to provide said emulation of said desired reflective surface of selected geometry.

13. The microwave phasing structure of claim 1 wherein said reflective means comprises a dichroic structure which is opaque to said incident electromagnetic waves within said operating frequency band, and which is transparent to said incident electromagnetic waves outside of said operating frequency band.

14. The microwave phasing structure of claim 1 wherein said support matrix is a dielectric substrate having a first side and a second side, said reflective means being disposed on said first side of said dielectric substrate, and said arrangement of electromagnetically-loading structures being disposed on said second side of said dielectric substrate, said electromagnetically-loading structures being disposed at a distance from said reflective means by said support matrix whereby said emulation of said desired reflective surface of selective geometry is provided.

15. A method of electromagnetically emulating a desired reflective surface of selected geometry over an operating frequency band, comprising:

(a) providing a microwave phasing structure including support matrix, a reflective means for reflecting microwaves within said operating frequency band, and phasing arrangement of electromagnetically-loading structures generally being resonant at some frequency outside of said operating frequency band, varying in dimension and having an orientation and interspacing from each other, and being disposed at a distance from said reflective means by said support matrix; and (b) providing an incident electromagnetic wave within said operating frequency band to the side of said support matrix supporting said phasing arrangement of electromagnetically-loading structures, said incident electromagnetic waves being reflected, phase shifted and diffracted as said incident electromagnetic waves propagate through said support matrix and reflect from said reflective means to thereby electromagnetically emulate said desired reflective surface of selected geometry.

16. The method of claim 15 wherein said distance being less than the wavelength of the lowest frequency of said operating frequency band is in the range of from about 0.1 GHZ to about 300 GHZ.

17. The method of claim 15 wherein said reflective means is a metallic reflecting layer.

18. The method of claim 15 wherein said desired reflective surface is a curved surface.

19. The method of claim 15 wherein the geometry of said support matrix is substantially planar.

20. The method of claim 19 wherein said electromagnetically-loading structures comprise an array of metallic patterns.

21. The method of claim 20 wherein each metallic pattern of said array comprises a cross configuration, each said cross configuration varying in dimension and having an orientation and interspacing from each other and being disposed at a distance from said reflective means by said support matrix as to provide said desired reflective surface.

22. The method of claim 21 wherein said desired reflective surface comprises a parabolic reflector having a focal point and wherein all path lengths of said reflected incident electromagnetic waves to said focal point are phase equalized.

23. The method of claim 22 wherein said reflective means comprises a metallic reflective layer.

24. A microwave phasing structure for electromagnetically emulating a desired focusing element of selected geometry over an operating frequency band, which comprises:

(a) a support matrix;

(b) a first phasing arrangement of electromagnetically-loading structures supported by said support matrix and generally being resonant at some frequency outside of said operating frequency band; and (c) a second phasing arrangement of electromagnetically-loading structures supported by said support matrix and generally being resonant at some frequency outside of said operating frequency band, said electromagnetically-loading structures of said first phasing arrangement varying in dimension and having an orientation and interspacing from each other and being disposed at a distance from a corresponding electromagnetically loading structure of said second phasing arrangement, so as to provide said emulation of said desired focusing element of selected geometry.

25. The microwave phasing structure of claim 24 wherein said support matrix is of substantially planar geometry.

26. The microwave phasing structure of claim 25 wherein said geometry of said desired focusing element is of a plano-parabolic converging lens having a focal point and wherein all path lengths of incident electromagnetic waves to said focal point are phase equalized.

27. The microwave phasing structure of claim 25 wherein said electromagnetically-loading structures comprise an array of metallic patterns.

28. The microwave phasing structure of claim 27 wherein each metallic pattern of said array comprises a cross configuration, said cross configurations of said first phasing arrangement varying in dimension and having an orientation and interspacing from each other and each cross-configuration of said first phasing arrangement being disposed at a distance from a corresponding cross-configuration in said second phasing arrangement so as to provide said emulation of said desired focusing element.

29. The microwave phasing structure of claim 28 wherein said operating frequency band is from about 0.1 GHZ to about 300 GHZ.

30. The microwave phasing structure of claim 29 wherein said support matrix is a dielectric substrate.

31. The microwave phasing structure of claim 24 wherein the geometry of said support matrix is of substantially non-planar geometry.

32. The microwave phasing structure of claim 24 wherein the geometry of said support matrix is substantially non-planar, and wherein said geometry of said desired focusing element is of a converging lens having a focus wherein said all path lengths of incident electromagnetic waves to said focal point are phased equalized.

33. The microwave phasing structure of claim 32 wherein said first and second arrangements of electromagnetically loading structures each comprise an array of metallic patterns.

34. The microwave phasing structure of claim 1, wherein said microwave phasing structure further has an operating wavelength, and said distance is greater than or equal to about 1/16th of said operating wavelength and less than or equal to about ¼ of said operating wavelength.

35. The microwave phasing structure of claim 31 wherein said support matrix is a dielectric substrate.

36. A method of electromagnetically emulating a desired focusing element of selected geometry over an operating frequency band, which comprises:

(a) providing a microwave phasing structure including a support matrix, a first phasing arrangement of electromagnetically-loading structures supported by said support matrix and generally being resonant at some frequency outside said operating frequency band, and a second phasing arrangement of electromagnetically-loading structures supported by said support matrix and generally being resonant at some frequency outside of said operating frequency band, said electromagnetically-loading structures of said first phasing arrangement varying in dimension and having an orientation and interspacing from each other and each said electromagnetically-loading structure of said first phasing arrangement being disposed at a distance from a corresponding electromagnetically-loading structure of said second phasing arrangement so as to provide said emulation of said desired focusing element of selected geometry; and (b) providing an incident electromagnetic wave within said operating frequency band to one side of said support matrix, said incident electromagnetic waves being phase shifted and diffracted as said incident electromagnetic waves propagate through said microwave phasing structure, to thereby electromagnetically emulate said desired focusing element of selected geometry.

37. The method of claim 36 wherein the geometry of said support matrix is substantially planar.

38. The method of claim 36 wherein step (b) further comprises phase equalizing the path lengths of said incident electromagnetic waves as said incident electromagnetic waves propagate through said microwave phasing structure.

39. The method of claim 38 wherein said electromagnetically-loading structures comprise an array of metallic patterns.

40. The method of claim 39 wherein each metallic pattern of said array comprises a cross configuration, said cross configurations varying in dimension and having an orientation and interspacing from each other and each cross-configuration of said first phasing arrangement being disposed at a distance from a corresponding cross-configuration of said second phasing arrangement so as to provide said emulation of said desired focusing element of selected geometry.

41. The method of claim 37 wherein said geometry of said desired focusing element is of a plano-parabolic converging lens having a focal point, and wherein all path lengths of said incident electromagnetic waves to said focal point are phase equalized.

42. The method of claim 37 wherein said operating frequency band is from about 0.1 GHZ to about 300 GHZ.

43. A method of manufacturing a microwave phasing structure for electromagnetically emulating a desired reflective surface of selected geometry over an operating frequency band wherein said microwave phasing structure includes a dielectric substrate having disposed on one side thereof a reflective means and disposed on the other side thereof, a phasing arrangement of electromagnetically-loading structures generally being resonant at some frequency outside of said operating frequency band, varying in dimension and having an orientation and interspacing from each other and being disposed at a distance from said reflective means so as to provide said emulation of said desired reflective surface of selected geometry, said method comprising:

(a) providing a dielectric substrate having a reflective means disposed on one side thereof, and on the other side of which said phasing arrangement of electromagnetically-loading structures are to be disposed;

(b) selecting at least one geometry for said electromagnetically-loading structures;

(c) determining the dimensions, orientation and interspacing of said selected electromagnetically-loading structures as to provide said emulation of said desired reflective surface of selected geometry; and (d) providing to the other side of said dielectric substrate, said phasing arrangement of electromagnetically-loading structures varying in dimension and having an orientation and interspacing from each other as determined in step (c), whereby said microwave phasing structure is formed.

44. The method of claim 43 wherein step (c) comprises constructing on a computer-aided design system, a three-dimensional ray model of said microwave phasing structure, and using said three-dimensional ray model, computing said dimensions, orientation and interspacing of said selected electromagnetically-loading structures as to provide said emulation of said desired reflective surface of selected geometry.

45. The method of claim 43 wherein each said electromagnetically-loading structure comprises a metallic pattern.

46. The method of claim 45 wherein step (d) comprises:

(i) providing a metallic layer on said other side of said dielectric substrate, (ii) generating a composite pattern corresponding to said phasing arrangement of electromagnetically-loading structures determined in step (c), and (iii) removing portions of said metallic layer as to leave remaining therein, said composite pattern corresponding to said phasing arrangement of electromagnetically-loading structures.

47. The method of claim 46 wherein removing portions of said metallic layer is achieved by a photoetching process.

48. The method of claim 43 wherein said operating frequency band is from about 0.1 GHZ to about 300 GHZ.

49. The method of claim 43 wherein said dielectric substrate is substantially planar.

50. The method of claim 49 wherein said selected geometry of said desired reflective surface is of a parabolic reflector having a focal point, wherein all path lengths to said focal point are phase equalized.

51. The method of claim 45 wherein each metallic pattern is of an X configuration.

52. The microwave phasing structure according to claim 24, wherein said microwave phasing structure further has an operating wavelength, and wherein said distance is greater than or equal to about 1/16 of said operating wavelength and less than or equal to about $\frac{1}{4}$ of said operating wavelength.

53. A method of manufacturing a microwave phasing structure for electromagnetically emulating a desired microwave focusing element of selected geometry over an operating frequency band, wherein said microwave phasing structure includes a dielectric substrate having disposed on one side thereof, a first phasing arrangement of electromagnetically-loading structures, and having disposed on the other side thereof a second phasing arrangement of electromagnetically-loading structures, said first and second phasing arrangements generally being resonant at some frequency outside of said operating frequency band, varying in dimension, and having an orientation and interspacing from each other and each said electromagnetic loading structure of said first phasing arrangement being disposed at a distance from a corresponding electromagnetically-loading structure of said second arrangement, so as to provide said emulation of said desired microwave focusing element, said method comprising:

(a) providing said dielectric substrate on which said first and second phasing arrangements of electromagnetically-loading structures are to be disposed;

(b) selecting at least one geometry for said electromagnetically-loading structures;

(c) determining the dimensions, orientation and interspacing of said selected electromagnetically-loading structures as to provide said desired focusing element of selected geometry; and (d) providing to one side of said dielectric substrate, said first phasing arrangement of electromagnetically-loading structures, and providing to the other side of said dielectric substrate, said second phasing arrangement of electromagnetically-loading structures, said electromagnetically-loading structures having dimensions, orientation and interspacing from each other as determined in step (c).

54. The method of claim 53 wherein step (c) comprises constructing on a computer-aided design system, a three-dimensional ray model of said microwave phasing structure, and using said three-dimensional ray model, computing said dimensions, orientation and interspacing of said selected electromagnetically-loading structures as to provide said emulation of said desired microwave focusing element of selected geometry.

55. The method of claim 53 wherein each said electromagnetically-loading structure comprises a metallic pattern.

56. The method of claim 55 wherein step (d) comprises:

(i) providing a metallic layer on both said sides of said dielectric substrate;

(ii) generating a first composite pattern corresponding to said first phasing arrangement of electromagnetically-loading structures determined in step (c) and a second composite pattern corresponding to said second phasing arrangement of electromagnetically-loading structures determined in step (c); and (iii) removing portions of said metallic layers as to leave remaining therein, said first and second composite patterns corresponding to said first and second phasing arrangements of electromagnetically-loading structures respectively.

57. The method of claim 56 wherein removing portions of said metallic layers is achieved by a photoetching process.

58. The method of claim 53 wherein said operating frequency band is from 0.1 GHZ to about 300 GHZ.

59. The method of claim 53 wherein said dielectric substrate is substantially planar.

60. The method of claim 59 wherein said geometry of said desired microwave focusing element is of a plano-parabolic converging lens having a focal point, wherein all path lengths of incident electromagnetic waves in said frequency band to said focal point, are phase equalized.

61. The method of claim 55 wherein each metallic pattern comprises an X-shaped configuration.

62. The microwave phasing structure produced by the method of claim 53.

63. A method of designing an electrically thin microwave phasing structure for electromagnetically emulating a desired reflective surface of selected geometry over an operating frequency band, and being characterizable by a set of performance parameters, said method comprising:

(a) specifying a desired reflective surface to be electromagnetically emulated and a corresponding set of performance parameters;

(b) specifying a physical surface from which said desired reflective surface is to be electromagnetically emulated;

(c) determining path length differences between corresponding points on said physical surface and said reflective surface which path length differences are to be electromagnetically emulated;

(d) determining the desired phase shift corresponding to each said path length difference;

(e) selecting at least one electromagnetically-loading structure having a particular geometry, and which are to be dimensioned, oriented and interspaced from each other on a support matrix to form a phasing arrangement of electromagnetically-loading structures which are disposed at a distance from a reflective means supported by said support matrix and generally being resonant at some frequency outside of said operating frequency band, so as to form an electrically thin microwave phasing structure characterizable by design parameters; and (f) determining said design parameters so that said electrically thin microwave structure is characterized by said set of performance parameters, and provides said emulation of said desired reflective surface of selected geometry over said operating frequency band.

64. The method of claim 63, wherein step (f) involves determining said design parameters using a reiterative design process.

65. The method of claim 63, wherein said support matrix in step (e) comprises a dielectric substrate.

66. The method of designing an electrically thin microwave phasing structure for electromagnetically emulating desired microwave focusing element of selected geometry over an operating frequency and, being characterizable by a set of performance parameters, said method comprising:

(a) specifying a desired focusing element to be electromagnetically emulated and a corresponding set of performance parameters;

(b) specifying a physical surface from which said desired focusing element is to be electromagnetically emulated;

(c) determining path length differences between corresponding points on said physical surface and the surface of focusing said element, which path length differences are to be electromagnetically emulated;

(d) determining the desired phase shift corresponding to each path length difference;

(e) selecting at least one electromagnetically-loading structure having a particular geometry, and which are to be dimensioned, oriented and interspaced from each other on a support matrix to form on the first side thereof a first phasing arrangement of electromagnetically-loading structures and on the second side thereof a second phasing arrangement of electromagnetically-loading structures, said first and second arrangements of electromagnetically-loading structures being disposed at a distance from each other by said support matrix, and generally being resonant at some frequency outside of said operating frequency band, so as to form an electrically thin microwave phasing structure characterizable by a set of design parameters; and (f) determining said set of design parameters so that said electrically thin phasing structure is characterized by said set of performance parameters, and provides said emulation of said microwave focusing element of selected geometry over said operating frequency band.

67. The method of claim 66 wherein said support matrix in step (e) comprises a dielectric substrate.

68. The method of claim 66 wherein step (f) involves determining said design parameters using a reiterative design process.

* * * * *